US010289059B2

(12) United States Patent
Soda et al.

(10) Patent No.: US 10,289,059 B2
(45) Date of Patent: May 14, 2019

(54) DRAWER UNIT AND IMAGE FORMING APPARATUS INCLUDING THE SAME

(71) Applicant: KONICA MINOLTA, INC., Chiyoda-ku, Tokyo (JP)

(72) Inventors: Koji Soda, Toyokawa (JP); Hideki Narahashi, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 93 days.

(21) Appl. No.: 15/491,369

(22) Filed: Apr. 19, 2017

(65) Prior Publication Data

US 2017/0308029 A1 Oct. 26, 2017

(30) Foreign Application Priority Data

Apr. 22, 2016 (JP) ..... 2016-086593

(51) Int. Cl.
*B65H 1/04* (2006.01)
*B65H 1/26* (2006.01)
(Continued)

(52) U.S. Cl.
CPC ..... *G03G 21/1647* (2013.01); *B65H 1/04* (2013.01); *B65H 1/266* (2013.01);
(Continued)

(58) Field of Classification Search
CPC ..... G03G 21/1647; G03G 15/6502; G03G 21/1623; G03G 2221/1654; B65H 1/04; B65H 1/266; B65H 2405/121
See application file for complete search history.

(56) References Cited

U.S. PATENT DOCUMENTS

2008/0111295 A1* 5/2008 Tanaka ..... B41J 13/103 271/164
2010/0172685 A1* 7/2010 Kim ..... B41J 13/103 400/613
(Continued)

FOREIGN PATENT DOCUMENTS

JP H11301861 A 11/1999
JP 2010143720 A 7/2010
JP 2012126575 A 7/2012

OTHER PUBLICATIONS

European Office Action corresponding to Application No. 17165941.0-1019; dated Jun. 18, 2018.
(Continued)

*Primary Examiner* — David H Banh
(74) *Attorney, Agent, or Firm* — Cantor Colburn LLP

(57) ABSTRACT

A drawer unit includes: a drawer member allowed to shift toward a storage unit in an inserting direction, or shift from the storage unit in a drawing direction; a lock member rotatably supported by the drawer member; a first regulation member that engages with the lock member to regulate a shift of the drawer member when the drawer member is located at a first position; a second regulation member that engages with the lock member to regulate a shift of the drawer member when the drawer member is located at a second position; and an operation unit that receives a first operation that rotates the lock member in the drawing direction to allow engagement between the lock member and the first regulation member, and a second operation that rotates the lock member in the inserting direction to allow engagement between the lock member and the second regulation member.

18 Claims, 20 Drawing Sheets

(51) Int. Cl.
*G03G 15/00* (2006.01)
*G03G 21/16* (2006.01)

(52) U.S. Cl.
CPC ..... *G03G 15/6502* (2013.01); *G03G 21/1623* (2013.01); *B65H 2405/121* (2013.01); *G03G 2221/1654* (2013.01)

(56) References Cited

U.S. PATENT DOCUMENTS

| | | | | |
|---|---|---|---|---|
| 2014/0021680 | A1 | 1/2014 | Hamasaki | |
| 2018/0180106 | A1* | 6/2018 | Hara ..... | G03G 21/1647 |

OTHER PUBLICATIONS

Extended European Search Report for corresponding EP Application No. 17165941.0-1701; dated Oct. 30, 2017.
SIPO First Office Action corresponding to CN Application No. 201710248488.3; dated Sep. 29, 2018.

* cited by examiner

DRAWER UNIT AND IMAGE FORMING APPARATUS INCLUDING THE SAME

CROSS REFERENCE TO RELATED APPLICATIONS

The entire disclosure of Japanese Patent Application No. 2016-086593 filed on Apr. 22, 2016 including description, claims, drawings, and abstract are incorporated herein by reference in its entirety.

BACKGROUND OF THE INVENTION

Field of the Invention

The present invention relates to an image forming apparatus, and further to a lock mechanism of a drawer unit which is included in an image forming apparatus to store an article such as recording paper.

Description of the Related Art

An image forming apparatus, such as a printer and a multifunction peripheral (MFP) of a printer, includes a paper cassette for storing recording paper on which an image is formed. The paper cassette is detachably attached to a cassette storage unit included in an image forming apparatus body. According to this type of image forming apparatus, recording paper stored in the paper cassette is sequentially conveyed to an image forming unit to form an image on the recording paper thereat at the time of image formation.

The paper cassette of the image forming apparatus is drawn from the cassette storage unit for replenishment of recording paper. A lock mechanism is provided to prevent separation of the paper cassette from the cassette storage unit, which may be caused when the paper cassette is drawn from the cassette storage unit.

It is preferable to detach the paper cassette from the cassette storage unit at the time of maintenance of the image forming apparatus, for example, to increase work efficiency. Accordingly, a predetermined unlock operation is performed for the lock mechanism to detach the paper cassette from the cassette storage unit. There have been proposed, for example, a lock mechanism which performs an unlock operation for raising a tip of the paper cassette upward in a maximum drawn-out state of the paper cassette (JP 2012-126575 A), and a lock mechanism which performs an unlock operation for revolving (rotating) a lock member provided on aside surface of the paper cassette upward and downward (JP 11-301861 A).

The paper cassette is often disposed in a lower part of the image forming apparatus. In this case, force for raising the tip of the paper cassette may be added to the paper cassette as well as force for pulling the paper cassette when an operator performs a drawing operation for drawing the paper cassette. According to an image forming apparatus including the lock mechanism described in JP 2012-126575 A, therefore, the unlock operation may be unconsciously performed during the drawing operation in the maximum drawn state of the paper cassette. In this case, the paper cassette may drop during the action for drawing the paper cassette.

On the other hand, according to an image forming apparatus including the lock mechanism described in JP 11-301861 A, the lock member provided on the side surface of the paper cassette is operated to perform the unlock operation. In this case, an operator usually operates the lock member without visually recognizing the lock member. When the unlock operation is a revolving operation upward and downward, the operator may perform the unlock operation unintentionally while feeling for the lock member, and may drop the paper cassette.

SUMMARY OF THE INVENTION

Accordingly, an object of the present invention is to provide a drawer unit capable of reducing a possibility of a drop of a drawer member against an intention of a user.

To achieve the abovementioned object, according to an aspect, a drawer unit reflecting one aspect of the present invention comprises: a drawer member allowed to shift toward a storage unit in an inserting direction, or shift from the storage unit in a drawing direction; a lock member rotatably supported by the drawer member; a first regulation member that is included in the storage unit and engages with the lock member to regulate a shift of the drawer member in the drawing direction when the drawer member is located at a first position within the storage unit; a second regulation member that is included in the storage unit and engages with the lock member to regulate a shift of the drawer member in the drawing direction when the drawer member is located at a second position drawn from the first position; and an operation unit that receives a first operation that rotates the lock member in the drawing direction to allow engagement between the lock member and the first regulation member, and a second operation that rotates the lock member in the inserting direction to allow engagement between the lock member and the second regulation member.

According to the drawer unit described above, the lock member is preferably allowed to engage with the first regulation member in a first posture of the lock member, is preferably allowed to engage with the second regulation member in a second posture of the lock member rotated in a predetermined direction from the first posture, and is preferably released from engagement with the second regulation member in a third posture of the lock member further rotated in the predetermined direction from the second posture, and the lock member is preferably rotated to the second posture by the first operation, and rotated to the third posture by the second operation.

According to the drawer unit described above, the operation unit is preferably attached to the drawer member.

According to the drawer unit described above, the operation unit preferably includes a first contact portion that contacts and presses the lock member in the first operation, and a second contact portion that contacts and presses the lock member in the second operation, and the first contact portion and the second contact portion are preferably disposed on sides opposite to each other with respect to a rotation center of the lock member.

According to the drawer unit described above, the lock member preferably includes a rotation portion whose intermediate portion is rotatably supported by the drawer member, a lever portion that extends from one end of the rotation portion, and a hook portion that extends in a direction opposite to the rotation portion from a tip of the lever portion, and is allowed to engage with the first regulation member or the second regulation member in accordance with a posture of the lock member, and each of the first regulation member and the second regulation member is preferably a protrusion that protrudes toward the lock member from the storage unit.

According to the drawer unit described above, the first contact portion preferably contacts another end of the rotation portion, and the second contact portion preferably contacts the one end of the rotation portion.

According to the drawer unit described above, the operation unit is preferably a member allowed to reciprocate in the inserting direction or the drawing direction of the drawer member, and the operation unit preferably includes an operation lever that supports the first contact portion and the second contact portion.

According to the drawer unit described above, a shift amount of the operation unit from an initial position to a shift end in the second operation is preferably larger than a shift amount of the operation unit from an initial position to a shift end in the first operation.

According to the drawer unit described above, a protrusion amount of the first regulation member is preferably smaller than a protrusion amount of the second regulation member.

According to the drawer unit described above, the operation unit preferably includes a stopper portion that contacts the lock member to regulate rotation of the lock member from the second posture to the third posture.

According to the drawer unit described above, the lock member preferably does not engage with the first regulation member but engages with the second regulation member when the lock member contacts the stopper portion to regulate the rotation of the lock member.

According to the drawer unit described above, the stopper portion preferably contacts the lock member when the first operation is performed for the operation unit, but preferably does not contact the lock member when the second operation is performed for the operation unit.

According to the drawer unit described above, the first position is preferably a position at which the drawer member is inserted to an innermost position of the storage unit, and the second position is preferably a position at which the drawer member is drawn to a maximum in a state supported by the storage unit.

According to the drawer unit described above, the operation unit preferably includes a first contact portion that contacts and presses the lock member in the first operation, and a second contact portion that contacts and presses the lock member in the second operation, and the first contact portion and the second contact portion are preferably disposed on sides opposite to each other with respect to a rotation center of the lock member.

According to the drawer unit described above, the lock member preferably includes a rotation portion whose intermediate portion is rotatably supported by the drawer member, a lever portion that extends from one end of the rotation portion, and a hook portion that extends in a direction opposite to the rotation portion from a tip of the lever portion, and is allowed to engage with the first regulation member or the second regulation member in accordance with a posture of the lock member, and each of the first regulation member and the second regulation member is preferably a protrusion that protrudes toward the lock member from the storage unit.

According to the drawer unit described above, the first contact portion preferably contacts another end of the rotation portion, and the second contact portion preferably contacts the one end of the rotation portion.

According to the drawer unit described above, a protrusion amount of the first regulation member is preferably smaller than a protrusion amount of the second regulation member.

To achieve the abovementioned object, according to an aspect, an image forming apparatus reflecting one aspect of the present invention comprises: the drawer unit described above; a paper feeding mechanism that extracts recording paper stored in the drawer unit; and an image forming unit that forms an image on the recording paper extracted from the paper feeding mechanism.

To achieve the abovementioned object, according to an aspect, a drawer unit reflecting one aspect of the present invention comprises: a drawer member allowed to shift toward a storage unit in an inserting direction, or shift from the storage unit in a drawing direction; a lock member rotatably supported by the drawer member; a first regulation member that is included in the storage unit and engages with the lock member to regulate a shift of the drawer member in the drawing direction when the drawer member is located at a first position within the storage unit; a second regulation member that is included in the storage unit and engages with the lock member to regulate a shift of the drawer member in the drawing direction when the drawer member is located at a second position drawn from the first position; and an operation unit that receives a first operation performed for the drawer member to rotate the lock member in the drawing direction and allow engagement between the lock member and the first regulation member, and a second operation performed for the drawer member to rotate the lock member in the inserting direction and allow engagement between the lock member and the second regulation member.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 3:
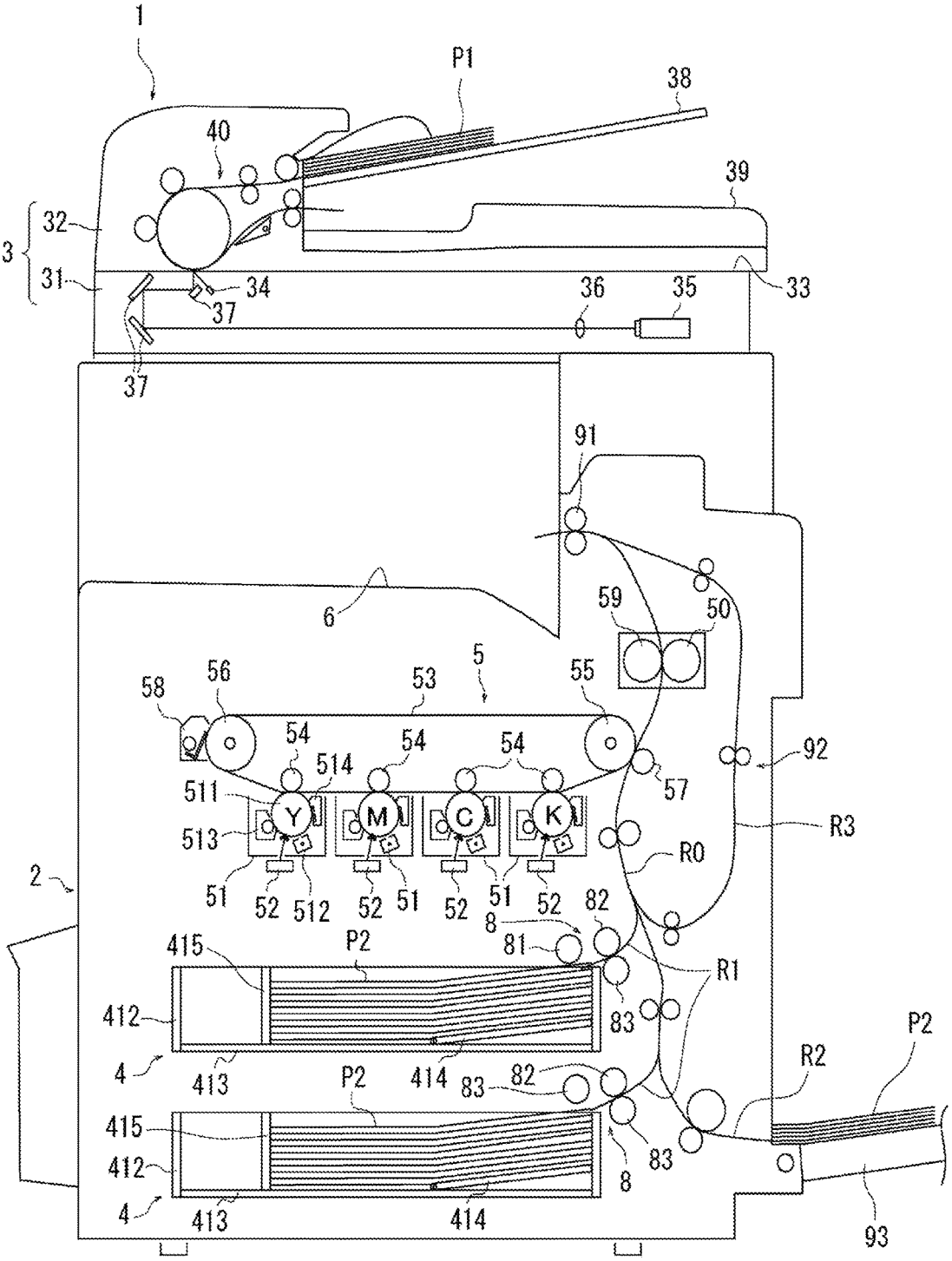
FIG. 3 is a schematic view illustrating an internal configuration of the image forming apparatus according to an embodiment of the present invention.

Hereinafter, an embodiment of the present invention will be described with reference to the drawings. However, the scope of the invention is not limited to the illustrated examples. Note that a direction perpendicular to a sheet surface of FIG. 3 is defined as a front view corresponding to a reference direction for respective terms indicating specific directions and positions (such as "left-right" and "up-down") used as necessary in the following description. These terms are only used for convenience of the description, and do not limit the technical scope of the invention of the present application.

<General Configuration of Image Forming Apparatus>

Figure 1:
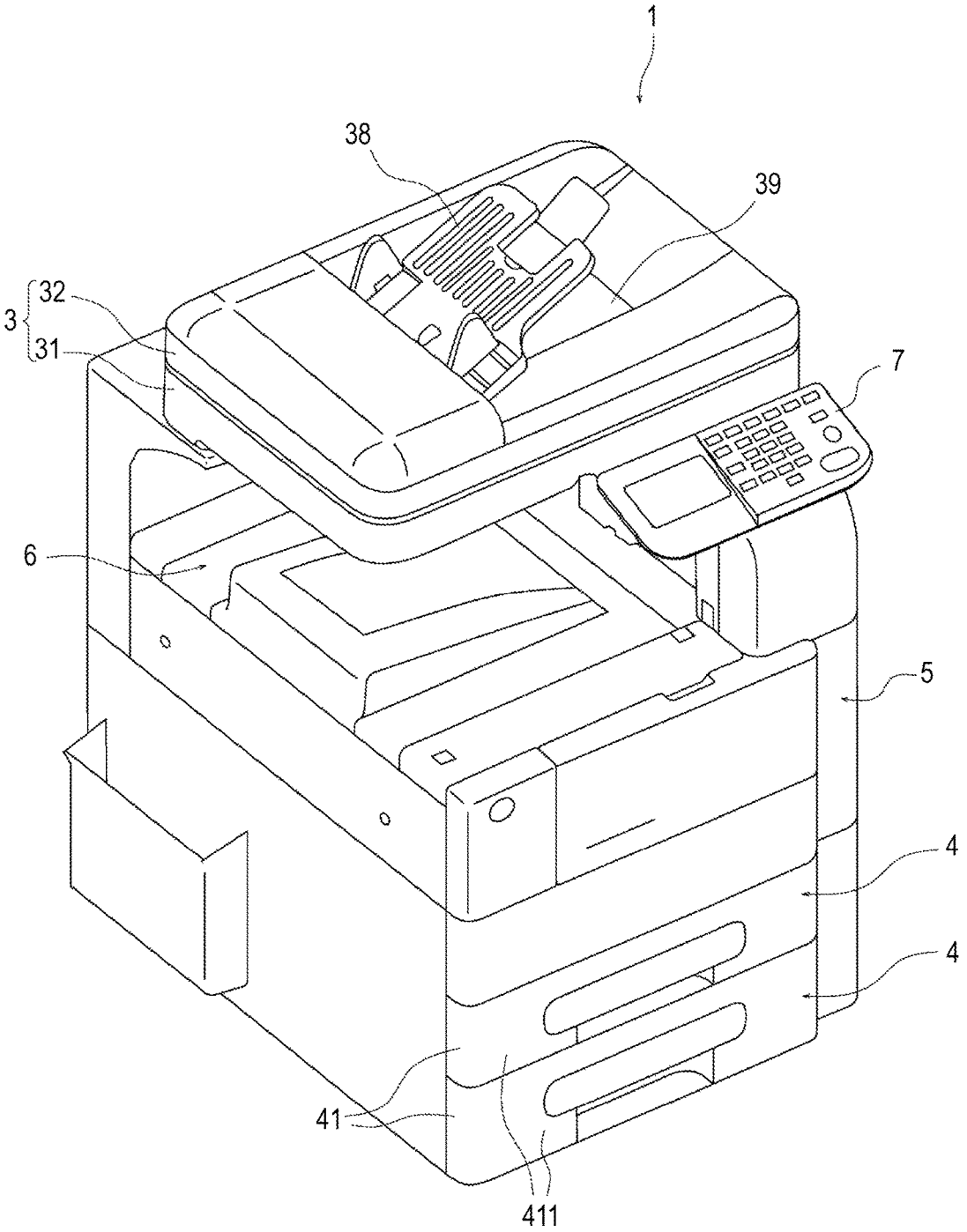
FIG. 1 is a perspective view of an external appearance of an image forming apparatus according to an embodiment of the present invention.
Figure 2:
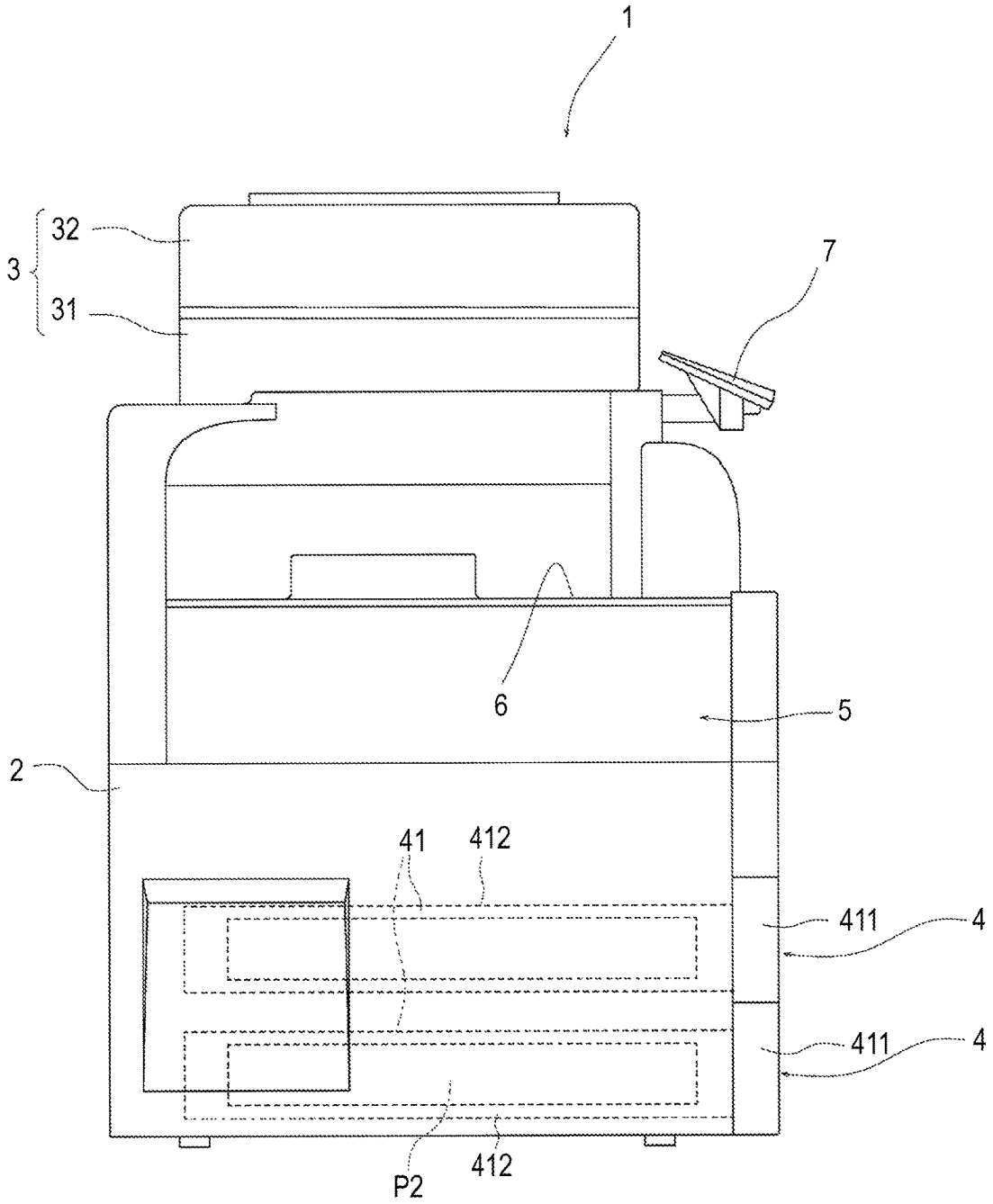
FIG. 2 is a right side view of the image forming apparatus.

A general configuration of an image forming apparatus is hereinafter described with reference to the drawings, presented as a configuration common to following respective embodiments. FIG. 1 is a perspective view illustrating an external appearance of the image forming apparatus according to an embodiment of the present invention, while FIG. 2 is a right side view of this image forming apparatus. FIG. 3 is a schematic view illustrating an internal configuration of the image forming apparatus according to an embodiment of the present invention. As illustrated in FIGS. 1 and 2, the image forming apparatus 1 includes an image reading unit 3, drawer units 4, an image forming unit 5, a discharge tray 6, and an operation panel 7.

The image reading unit 3 reads an image from a document P1. Each of the drawer units 4 stores recording paper P2 on which an image is to be formed. The image forming unit 5 forms an image on the recording paper P2 supplied from the drawer units 4. The recording paper P2 on which an image has been formed by the image forming unit 5 is discharged to the discharge tray 6. The operation panel 7 receives an operation input to the image forming apparatus 1. The image reading unit 3 is disposed in an upper portion of a device body 2 of the image forming apparatus 1, while the image forming unit 5 is disposed below the image reading unit 3.

The discharge tray 6 is disposed above the image forming unit 5 of the device body 2 to receive the recording paper P2 on which an image has been recorded by the image forming unit 5 after the recording paper P2 is discharged. Each of the drawer units 4 is detachably attached to the device body 2 below the image forming unit 5. The image forming apparatus 1 having the foregoing configuration forms (prints) an image on the recording paper P2 in a manner described below. More specifically, the recording paper P2 stored in the drawer units 4 is supplied to the interior of the device body 2, conveyed upward, and supplied to the image forming unit 5 disposed above the drawer units 4. Subsequently, an image is formed on the recording paper P2 by the image forming unit 5, whereafter the recording paper P2 is discharged to the discharge tray 6 provided in a space between the image reading unit 3 and the image forming unit 5 (recessed space). Respective units of the image forming apparatus 1 are hereinafter detailed.

The operation panel 7 is provided on the front side (front) of the device body 2. A user operates keys while viewing a display screen or the like of the operation panel 7 to set a function selected from respective functions of the image forming apparatus 1, and issue an instruction for operation to the image forming apparatus 1.

The image reading unit 3 is provided in the upper part of the device body 2 to read an image from the document P1. The image reading unit 3 includes a scanner unit 31, and an auto document feeder (ADF) unit 32. The scanner unit 31 reads an image from the document P1. The ADF 32 provided above the scanner unit 31 conveys the document P1 to the scanner unit 31 one by one.

As illustrated in FIG. 3, the scanner unit 31 of the image reading unit 3 includes a document table 33, a light source device 34, an image sensor 35, an imaging lens 36, and a mirror group 37. The document table 33 includes platen glass (not shown) disposed on the upper surface side of the document table 33. The light source device 34 applies light to the document P1. The image sensor 35 photoelectrically converts light reflected on the document P1 into image data. The imaging lens 36 forms an image of the reflection light on the image sensor 35. The mirror group 37 includes a plurality of mirrors to sequentially reflect the reflection light received from the document P1 and allow entrance of the reflection light into the imaging lens 36. The light source device 34, the image sensor 35, the imaging lens 36, and the mirror group 37 are provided inside the document table 33. The light source device 34 and the mirror group 37 are movable in the left-right direction with respect to the document table 33.

The ADF 32 is provided on the upper surface side of the scanner unit 31 in a manner openable and closable with respect to the document table 33. The ADF 32 also has a function of bringing the document P1 into close contact with the platen glass (not shown) of the document table 33 by covering the document P1 carried on the platen glass. The ADF 32 includes a document carry tray 38, and a document discharge tray 39.

When the document P1 on the platen glass (not shown) of the document table 33 is read by the image reading unit 3, light is applied to the document P1 from the light source device 34 shifting in the right direction (sub-scanning direction). Light reflected on the document P1 is sequentially reflected by the mirror group 37 shifting in the right direction similarly to the light source device 34 to enter the imaging lens 36 and form an image on the image sensor 35. The image sensor 35 executes photoelectric conversion for each pixel in accordance with intensity of incident light to generate an image signal (RGB signal) corresponding to an image of the document P1.

On the other hand, when the document P1 carried on the document carry tray 38 is read, the document P1 is conveyed to a reading position by a document feeding mechanism 40 including a plurality of rollers and the like. In this case, the light source device 34 of the scanner unit 31 and the mirror group 37 are fixed to predetermined positions inside the document table 33. Accordingly, light is applied to a portion of the reading position of the document P1 from the light source device 34, and reflected to pass through the mirror group 37 and the imaging lens 36 of the scanner unit 31. An image of the reflection light is thus formed on the image sensor 35. The image sensor 35 executes photoelectric conversion for each pixel in accordance with intensity of incident light to generate an image signal (RGB signal) corresponding to an image of the document P1. Thereafter, the document P1 is discharged to the document discharge tray 39.

Each of the drawer units 4 provided in a lower part of the device body 2 stores recording paper P2 on which an image is to be formed. Each of the drawer units 4 includes a paper cassette 41, and a cassette storage unit 42. The paper cassette 41 corresponds to a "drawer member", while the cassette storage unit 42 corresponds to a "storage unit" according to the appended claims. The paper cassette 41 slides in the front-rear direction with respect to the cassette storage unit 42 of the device body 2 for attachment and detachment of the paper cassette 41. The paper cassette 41 includes a front cover 411, and a recording paper storage portion 412. The front cover 411 is a plate-shaped member constituting a part of the front surface of the device body 2.

The recording paper storage portion 412 has a case-like shape including a bottom plate 413 on which the recording paper P2 is carried. The front, rear, left, and right sides of the bottom plate 413 are surrounded by side plates. A raising plate 414 is further provided on an upper surface of the bottom plate 413 on the right side of the bottom plate 413. The raising plate raises the recording paper P2 upward by upward and downward rotation of a right end side of the bottom plate 413. In addition, a recording paper regulating unit 415 is provided in a left part of the bottom plate 413. The recording paper regulating unit 415 protrudes from the bottom plate 413, and slides in the left-right direction. In this case, a left side end position of the recording paper P2 is regulated by the recording paper regulating unit 415 such that the right end side of the recording paper P2 contacts a right inner wall of the recording paper regulating unit 415. Furthermore, paper width regulating plates 416 are provided on the bottom plate 413 to regulate a paper width of the recording paper P2 carried on the raising plate 414. The paper width regulating plates 416 protrude from the bottom plate 413, and slide frontward and rearward (see FIG. 4).

After insertion of the paper cassette 41 into the cassette storage unit 42, the recording paper storage portion 412 is stored inside the device body 2. In addition, the front of the device body 2 is covered by the front cover 411. The drawer unit 4 will be more detailed below. A paper feeding mechanism 8 described below (see FIG. 3) is disposed on the right side of the recording paper storage portion 412 stored in the cassette storage unit 42. The recording paper P2 is drawn from the recording paper storage portion 412 by the function of the paper feeding mechanism 8, and conveyed to the image forming unit 5.

The paper feeding mechanism 8 includes an extracting roller 81, a feeding roller 82, and a handling roller 83. The extracting roller 81 extracts an uppermost layer of the recording paper P2 stored in the recording paper storage portion 412. The feeding roller 82 and the handling roller 83 are a pair of separation rollers for separating the recording paper P2 extracted by the extracting roller 81 for each sheet. The uppermost layer of the recording paper P2 stored in the recording paper storage portion 412 of the drawer unit 4 is conveyed sheet by sheet toward a main feed path R0 via a corresponding paper feed path R1 in accordance with rotations of the corresponding extracting roller 81, feeding roller 82, and handling roller 83. The main feed path R0 is a main path of the recording paper P2 during an image forming (printing) step. On the other hand, the paper feed path R1 is provided for each of the drawer units 4, and joined to the main feed path R0.

A manual tray 93 is provided on one side portion (right side portion in this embodiment) of the device body 2 in the left-right direction. The recording paper P2 in a predetermined size is supplied to the manual tray 93 from the outside. The manual tray 93 is a subsidiary unit provided separately from the drawer unit 4 provided as a main unit within the device body 2. The manual tray 93 is attached to the one side portion of the device body 2 in the left-right direction in a manner rotatable to open and close the one side portion. The uppermost layer of the recording paper P2 carried on the manual tray 93 is conveyed sheet by sheet toward the main feed path R0 via a manual feed path R2 in accordance with rotation of an extracting roller and the like.

The recording paper P2 conveyed to the main feed path R0 reaches the image forming unit 5, where an image is formed (printed) on the recording paper P2. The image forming unit 5 includes a transfer unit which transfers a toner image to the recording paper P2, and a fusing unit which fuses the toner image on the recording paper P2. The transfer unit of the image forming unit 5 includes imaging units 51, exposure units 52, an intermediate transfer belt 53, primary transfer rollers 54, a driving roller 55, a driven roller 56, a secondary transfer roller 57, and a cleaner unit 58. As illustrated in FIG. 3, each of the imaging units 51 forms a toner image in corresponding one of colors of yellow (Y), magenta (M), cyan (C), and key tone (K). Each of the imaging units 51 forming a toner image in Y, M, C, or K has the same configuration other than toner to be used. Accordingly, only constituent members of the imaging unit 51 for Y color have been given reference numbers in FIG. 3 to present description of the imaging unit 51 for Y color. However, each of the imaging units 51 for M, C, and K colors has the same configuration.

The imaging unit 51 includes a photosensitive drum 511, a charging unit 512, a developing unit 513, and a cleaner unit 514. The photosensitive drum 511 contacts an outer circumferential surface of the intermediate transfer belt 53. The charging unit 512 charges an outer circumferential surface of the photosensitive drum 511 by corona discharge. While a non-contact system achieving charge by corona discharge is used in this embodiment, a contact system achieving charge by contact with a roller or a brush may be adopted. The developing unit 513 causes stirred and charged toner to adhere to the outer circumferential surface of the photosensitive drum 511. The cleaner unit 514 removes toner remaining on the outer circumferential surface of the photosensitive drum 511 after transfer of the toner image to the intermediate transfer belt 53.

The photosensitive drum 511 is disposed at a position facing the primary transfer roller 54 with the intermediate transfer belt 53 interposed between the photosensitive drum 511 and the primary transfer roller 54, and rotates clockwise as viewed in FIG. 3. In this case, the primary transfer roller 54, the cleaner unit 514, the charging unit 512, the exposure unit 52, and the developing unit 513 are sequentially disposed around the photosensitive drum 511 in the rotation direction of the photosensitive drum 511.

The exposure unit 52 is provided below each of the imaging units 51 for the respective colors. For example, the exposure unit 52 applies laser beams or the like to the photosensitive drum 511 to form an electrostatic latent image on the photosensitive drum 511.

The intermediate transfer belt 53 contacts the imaging units 51 for the respective colors disposed in a line in the horizontal direction to receive toner images in the respective colors produced and transferred by the imaging units 51. The intermediate transfer belt 53 is constituted by an endless belt member having conductivity, for example. The primary transfer rollers 54 are disposed at positions facing the imaging units 51 in the respective colors on the upper side of the imaging units 51 with the intermediate transfer belt 53 sandwiched between the imaging units 51 and the primary transfer rollers 54.

The intermediate transfer belt 53 is wound around the driving roller 55 and the driven roller 56 without looseness. The driving roller 55 in this state is rotated by a driving device such as a not-shown motor to rotate the intermediate transfer belt 53. Note that the rotation direction is the anticlockwise direction as viewed in FIG. 3. The rotation of the driving roller 55 is transmitted to the intermediate transfer belt 53, whereby the primary transfer roller 54 and the driven roller 56 contacting the intermediate transfer belt 53 start rotation. The secondary transfer roller 57, the cleaner unit 58, and the imaging units 51 in the respective colors of Y, M, C, and K are sequentially disposed around the intermediate transfer belt 53 in the rotation direction of the intermediate transfer belt 53.

The secondary transfer roller 57 is disposed at a position facing the driving roller 55 with the intermediate transfer belt 53 interposed between the secondary transfer roller 57 and the driving roller 55. The cleaner unit 58 is disposed at a position facing the driven roller 56 with the intermediate transfer belt 53 interposed between the cleaner unit 58 and the driven roller 56.

The image forming unit 5 includes a heating roller 59 and a pressurizing roller 50 as a fusing unit. The heating roller 59 includes a halogen lamp or the like for heating and fusing a toner image on the recording paper P2. The pressurizing roller 50 pressurizes the recording paper P2 sandwiched between the pressurizing roller 50 and the heating roller 59. Note that the heating roller 59 may be constituted by a roller which generates eddy current on the surface of the heating roller 59 by electromagnetic induction to heat the surface of the heating roller 59.

A pair of discharge rollers 91 is disposed on the downstream part of the main feed path R0 with respect to the fusing unit constituted by the heating roller 59 and the pressurizing roller 50. The discharge rollers 91 are provided to discharge the recording paper P2 after printing. The recording paper P2 after printing is discharged to the discharge tray 6 in accordance with rotation of the pair of discharge rollers 91.

There is further provided a circulating feed unit 92 within the device body 2 of the image forming apparatus 1 which includes the respective units configured as above. The circulating feed unit 92 is provided to reverse the recording paper P2 after single-side printing, and perform both-side printing of the reversed recording paper P2. The circulating feed unit 92 includes a pair of reversing rollers for reversing the recording paper P2 after single-side printing, and a plurality of pairs of both-side feed rollers. The circulating feed unit 92 reverses the recording paper P2 after single-side printing, and conveys the reversed recording paper P2 again to the main feed path R0 via a circulating feed path R3. In this case, the pair of discharge rollers 91 is configured to rotate both in the normal and reverse directions to function as a pair of reversing rollers as well. The rotation of the pair of discharge rollers 91 both in the normal and reverse directions allows discharge of the recording paper P2 to the outside of the image forming apparatus 1, and also switch-back of the recording paper P2 (reverse feed) again into the image forming apparatus 1. The upstream side of the circulating feed path R3 is branched at a portion of the main feed path R0 between the fusing unit of the image forming unit 5 and the pair of discharge rollers 91. The downstream side of the circulating feed path R3 is joined to the upstream side of the transfer unit of the image forming unit 5.

A printing operation performed by the image forming apparatus 1 is hereinafter briefly described. The image forming apparatus 1 starts the printing operation in response to reception of a start signal, an image signal or the like. With the start of the printing operation, the recording paper P2 extracted from one of the drawer units 4 by the function of the paper feeding mechanism 8 is conveyed to the image forming unit 5 through the main feed path R0. The image forming unit 5 performs transfer and fusion of an image to the recording paper P2 based on a color electrographic system, and also performs an intermediate transfer system using the intermediate transfer belt 53 as an image transfer system to the recording paper P2.

Laser beams are applied from the exposure unit 52 to the surface of the photosensitive drum 511 charged by the charging unit 512 in each of the imaging units 51 for the respective colors of Y, M, C, and K in the transfer unit of the image forming unit 5, whereby an electrostatic latent image is formed in correspondence with an image in the corresponding color of Y, M, C, and K. Toner charged by the developing unit 513 shifts to the surface of the photosensitive drum 511 on which the electrostatic latent image has been formed to form a toner image on the surface of the photosensitive drum 511. In this case, the toner image carried on the surface of the photosensitive drum 511 is brought into contact with the intermediate transfer belt 53, and transferred to the intermediate transfer belt 53 by electrostatic force of the primary transfer roller 54. As a result, a toner image on which the respective colors of Y, M, C, and K are overlapped is formed on the surface of the intermediate transfer belt 53. On the other hand, not-transferred toner remaining on the photosensitive drum 511 after transfer of the toner image to the intermediate transfer belt 53 is scraped by the cleaner unit 514 to be removed from the surface of the photosensitive drum 511.

The toner image transferred to the intermediate transfer belt 53 shifts to a transfer position in contact with the secondary transfer roller 57 in accordance with rotation of the intermediate transfer belt 53 produced by the driving roller 55 and the driven roller 56, and is transferred to the recording paper P2 conveyed to the transfer position of the main feed path R0. Not-transferred toner remaining on the intermediate transfer belt 53 after transfer of the toner image to the recording paper P2 is scraped by the cleaner unit 58 to be removed from the surface of the intermediate transfer belt 53. On the other hand, the recording paper P2 to which the toner image has been transferred at the position in contact with the secondary transfer roller 57 is conveyed to the fusing unit constituted by the heating roller 59 and the pressurizing roller 50.

The recording paper P2 on one surface of which the not-fused toner image has been carried is heated by the heating roller 59 and pressurized by the pressurizing roller 50 during passage through a fusing position of the fusing unit. As a result, the not-fused toner image is fused on the sheet surface. In case of single-side printing, the recording paper P2 after fusion of the toner image (after single-side printing) is discharged to the discharge tray 6 by the pair of discharge rollers 91. In case of both-side printing, the recording paper P2 after single-side printing is conveyed to the circulating feed path R3 for both-side printing and reversed, and again is returned to the main feed path R0 for transfer and fusion of a toner image to the other surface of the recording paper P2 by the image forming unit 5, and then discharged to the discharge tray 6.

Image forming apparatuses presented in following embodiments have the same configuration of the image forming apparatus 1 described above, but have different configurations of paper cassettes and parts around the paper cassettes. Accordingly, the configurations of the paper cassettes and parts around the paper cassettes are hereinafter particularly detailed in the following embodiments.

<First Embodiment>

Figure 4:
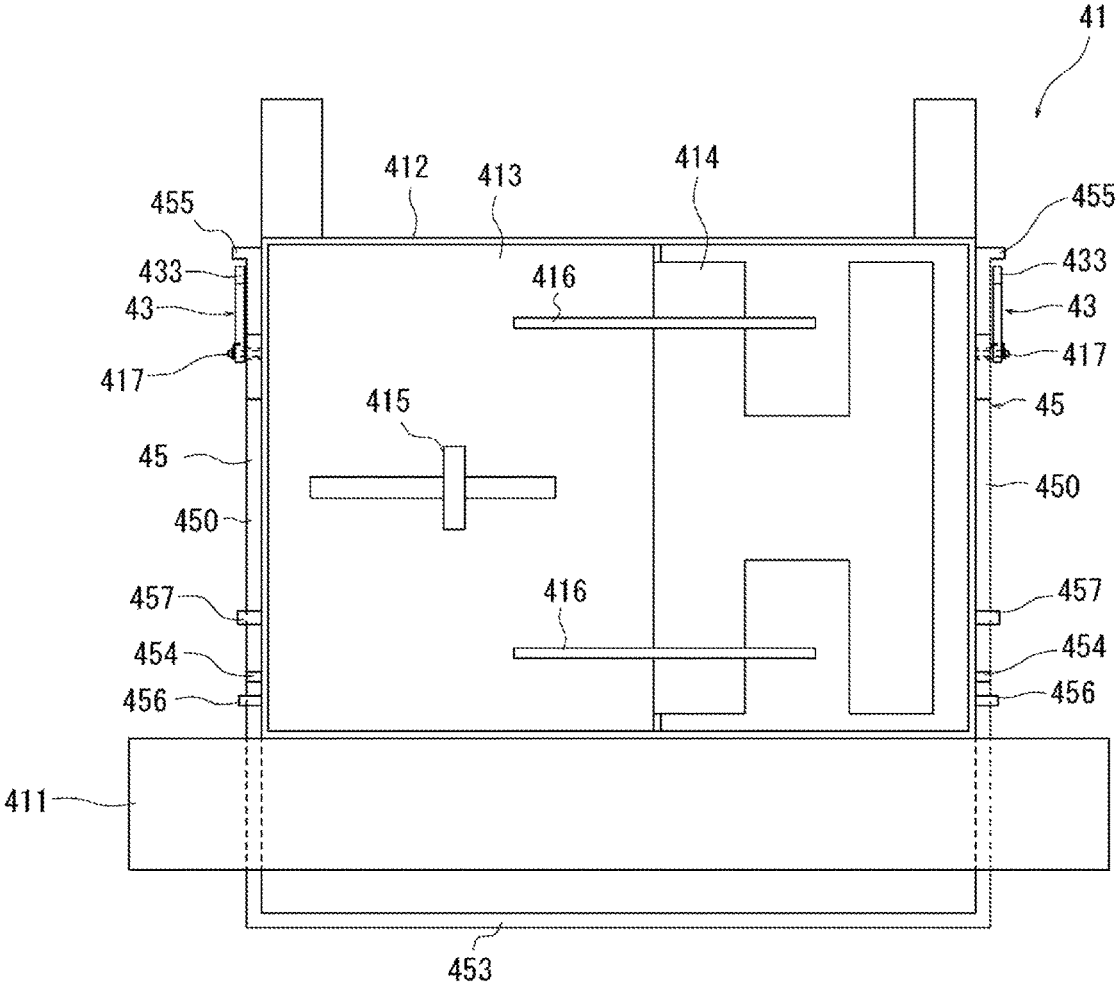
FIG. 4 is a plan view of a paper cassette of a drawer unit according to an embodiment of the present invention.
Figure 5:
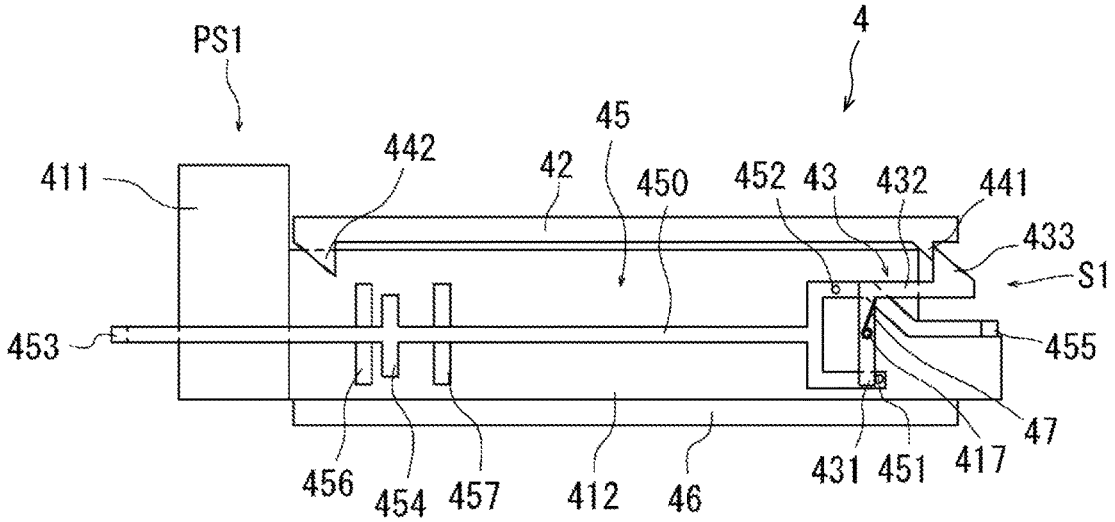
FIG. 5 is a schematic view of a drawer unit when a paper cassette is located at a first position according to an embodiment of the present invention.
Figure 6:
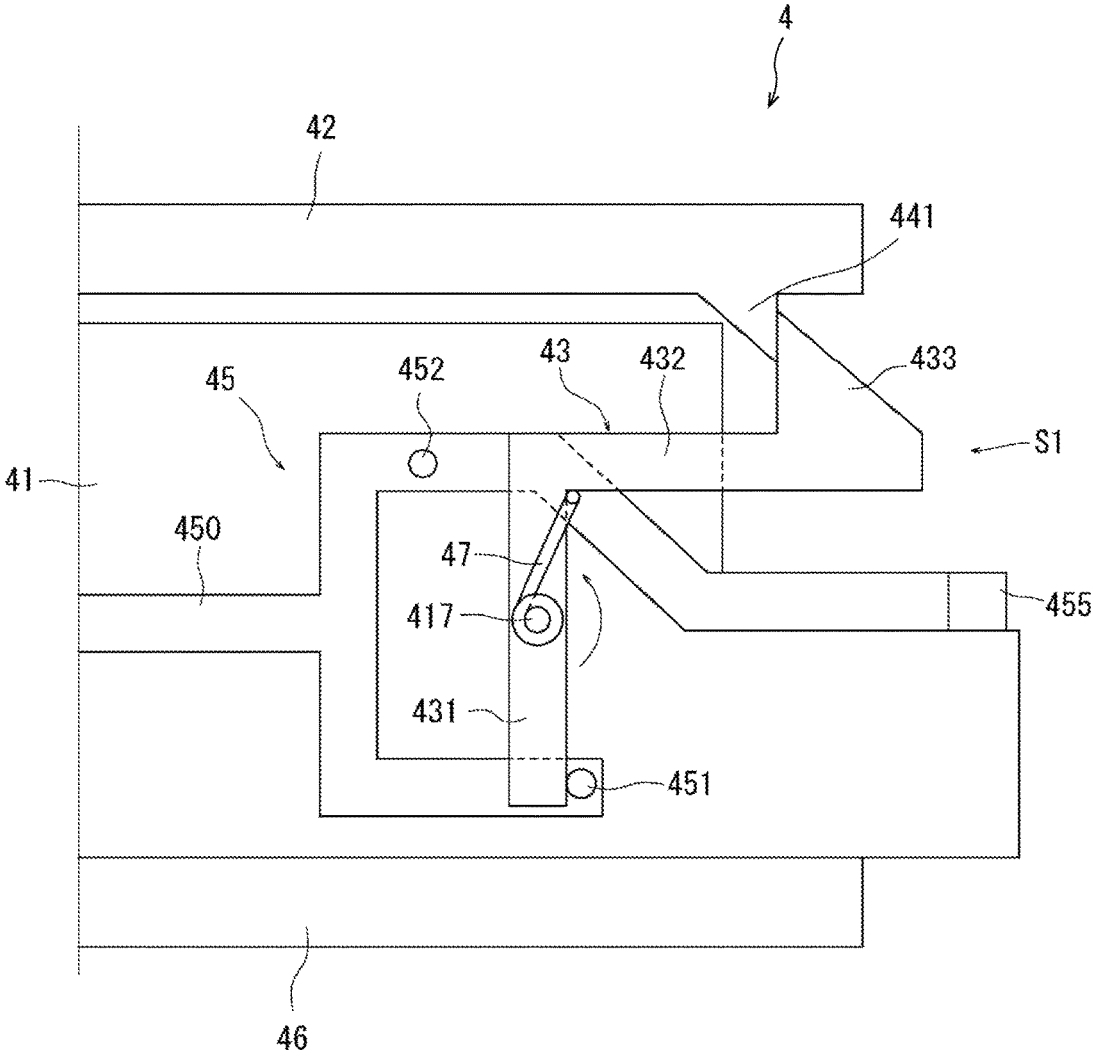
FIG. 6 is an enlarged view of a lock member of the drawer unit illustrated in FIG. 5.
Figure 7:
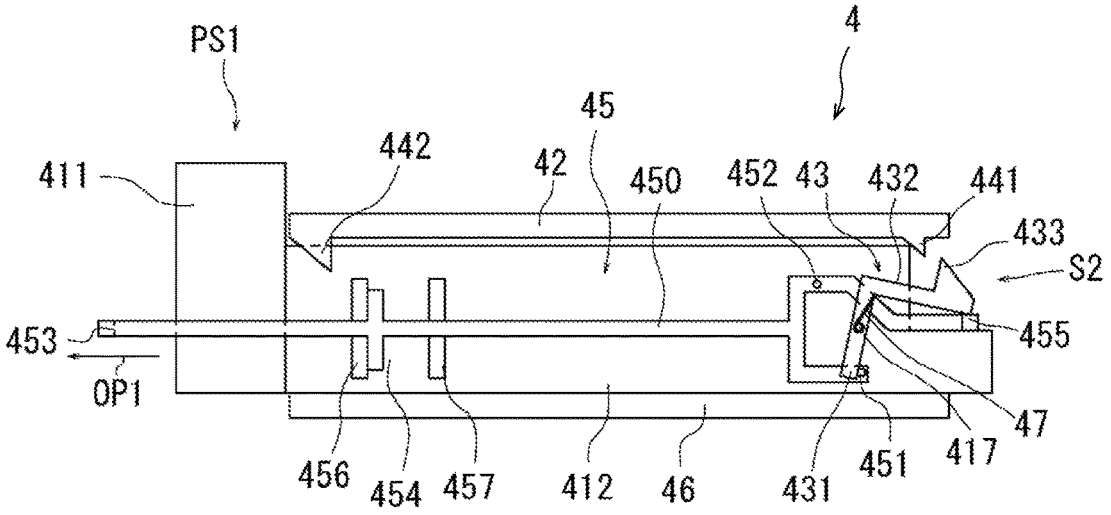
FIG. 7 is a schematic view of the drawer unit when the lock member is in a second posture.
Figure 8:
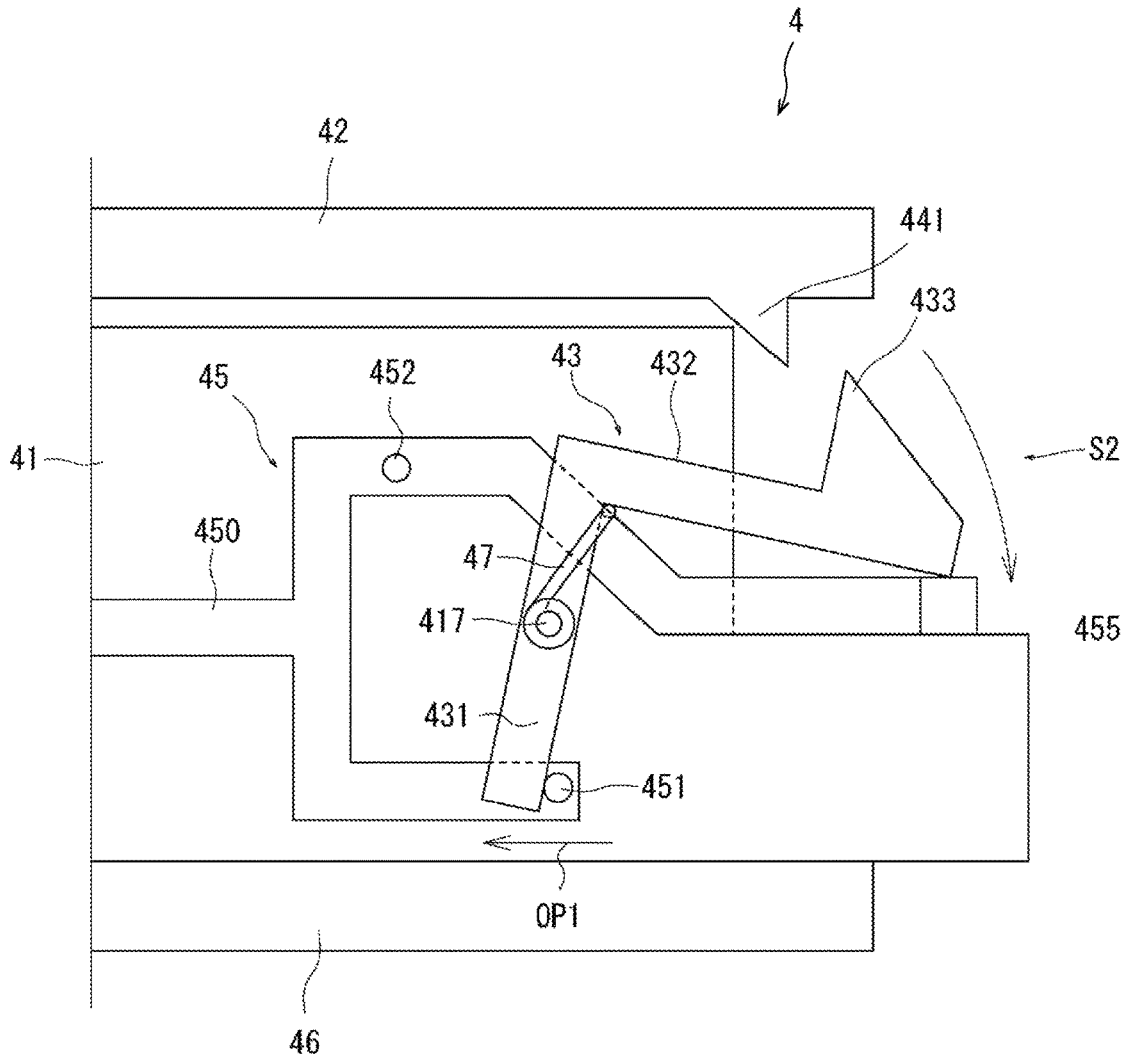
FIG. 8 is an enlarged view of the lock member of the drawer unit illustrated in FIG. 7.
Figure 9:
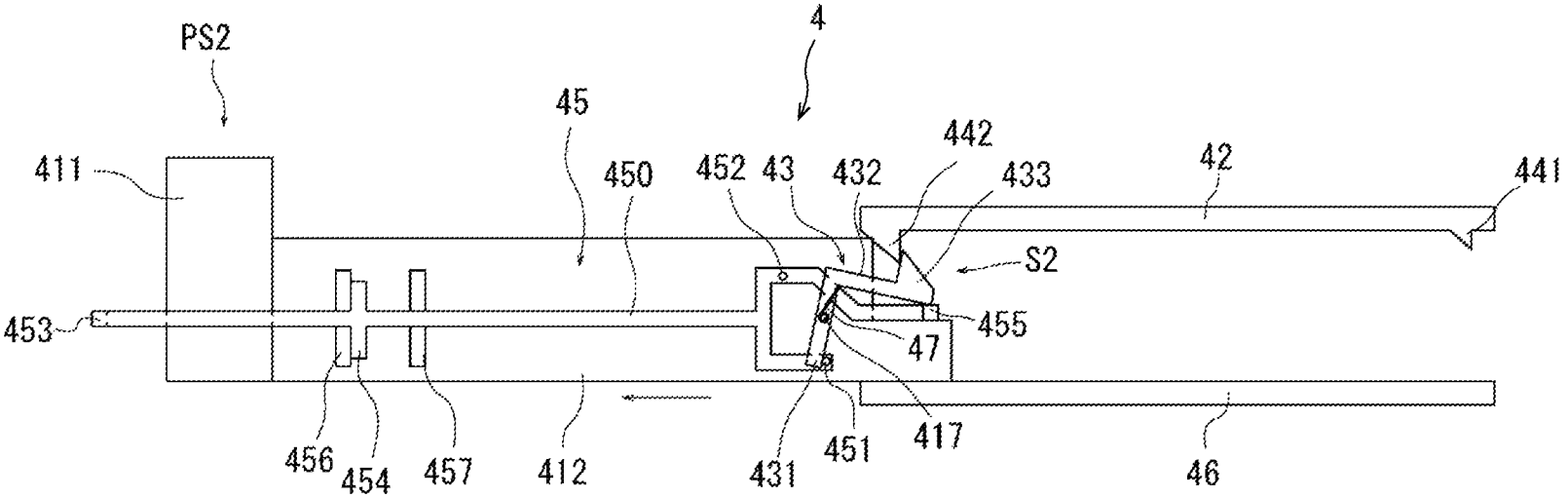
FIG. 9 is a schematic view of the second posture of the lock member and a second position of a drawer member.
Figure 10:
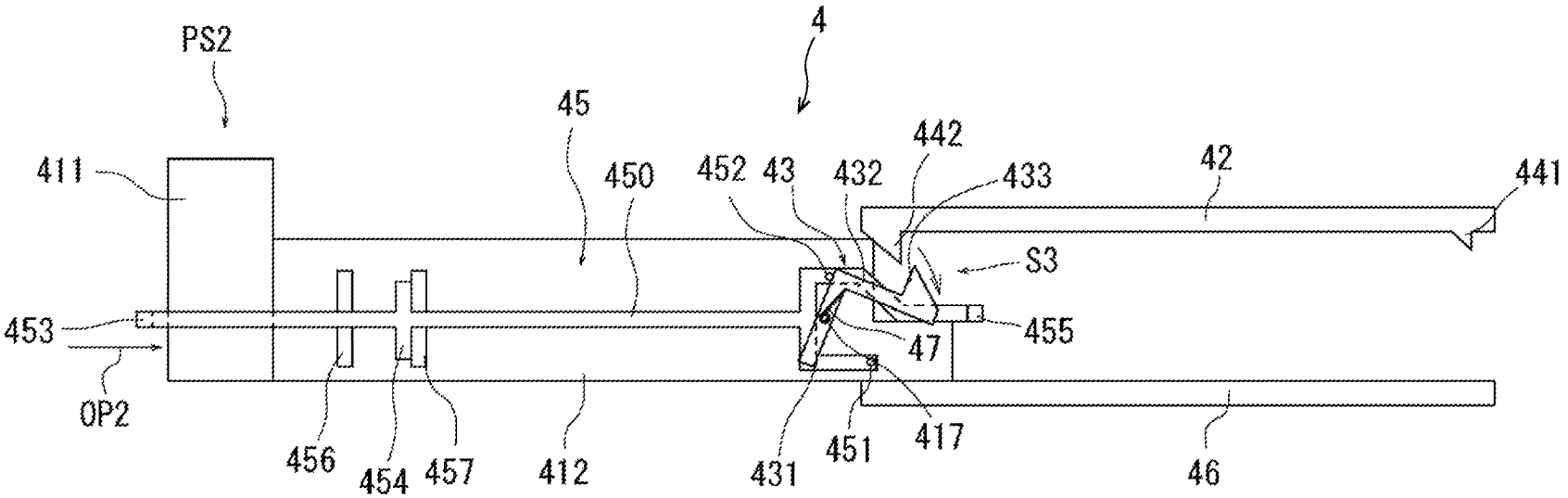
FIG. 10 is a schematic view of the drawer unit when the lock member is in a third posture.
Figure 11:
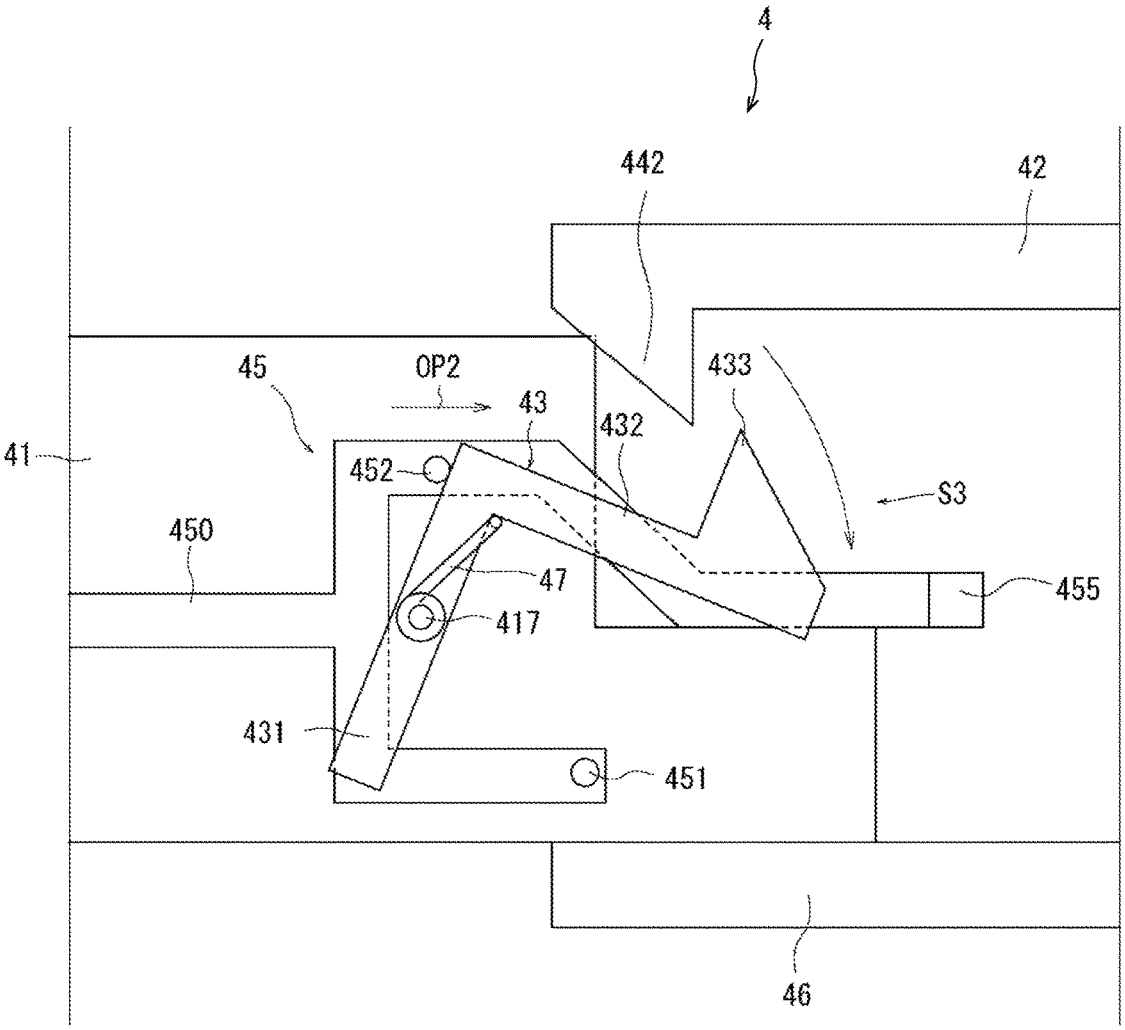
FIG. 11 is an enlarged view of the lock member of the drawer unit illustrated in FIG. 10.

Each of the drawer units 4 corresponding to a main part of the present invention is hereinafter detailed with reference to the drawings. FIG. 4 is a plan view of the paper cassette of the drawer unit according to this embodiment of the present invention. FIG. 5 is a schematic view of the drawer unit when the paper cassette is located at a first position according to this embodiment of the present invention. FIG. 6 is an enlarged view of a lock member of the drawer unit illustrated in FIG. 5. FIG. 7 is a schematic view of the drawer unit when the lock member is in a second posture. FIG. 8 is an enlarged view of the lock member of the drawer unit illustrated in FIG. 7. FIG. 9 is a schematic view of the second posture of the lock member and a second position of a drawer member and. FIG. 10 is a schematic view of the drawer unit when the lock member is in a third posture. FIG. 11 is an enlarged view of the lock member of the drawer unit illustrated in FIG. 10. The drawer unit 4 is drawn from the cassette storage unit 42 by a frontward shift of the paper cassette 41, and is inserted into the cassette storage unit 42 by a rearward shift of the paper cassette 41.

As illustrated in FIGS. 4 and 5, the drawer unit 4 includes a lock member 43, a first protruding portion 441, a second protruding portion 442, an operation unit 45, a rail 46, and a spring 47, as well as the paper cassette 41 and the cassette storage unit 42. As illustrated in FIG. 4, these members are provided on each of the left and right sides of the paper cassette 41, and have the same configurations except that the members on one side have a mirror image of the members on the opposite side. The right side is hereinafter described by way of example unless specified otherwise.

The lock member 43 is rotatably supported by a rotation shaft 417 protruding from an outer surface of a left or right side wall of the recording paper storage portion 412 of the paper cassette 41. The lock member 43 includes a rotation portion 431, a lever portion 432, and a hook portion 433. The rotation portion 431 is beam-shaped, and rotatably supported by the rotation shaft 417 via a through hole formed in an intermediate portion of the rotation portion 431. The lever portion 432 crosses one end of the rotation portion 431 (upper end in FIG. 6) at right angles in a rotation direction (clockwise direction around the rotation shaft 417 in FIG. 6). The lever portion 432 and the rotation portion 431 are not required to cross each other at right angles, but may cross in a different manner as long as a certain angle is formed by the lever portion 432 and the rotation portion 431. The lever portion 432 is beam-shaped similarly to the rotation portion 431. The hook portion 433 protrudes from a tip of the lever portion 432 to the side opposite to the rotation portion 431 as viewed from the lever portion 432. The hook portion 433 has an inclined surface approaching the lever portion 432 on the side (rear side) opposite to the rotation portion 431. The end of the hook portion 433 on the rotation portion 431 side (front side) has a surface crossing the lever portion 432 at right angles. Accordingly, the hook portion 433 has a wedge shape tapering toward the tip.

The lock member 43 is urged by the spring 47. The spring 47 is a torsion spring wound around the rotation shaft 417. An end of the spring 47 is fixed to the rotation shaft 417, while the other end engages with the lock member 43 at a crossing portion of the rotation portion 431 and the lever portion 432. The spring 47 is not limited to the torsion spring adopted in this embodiment. For example, the lock member 43 may be urged by a coil spring, or by rubber or the like. Various types of elastic members capable of producing force for rotating the lock member 43 may be adopted. In addition, the lock member 43 may be configured to be urged by a weight or the like as an urging mechanism other than elastic members. As illustrated in FIG. 6 and other figures, the spring 47 urges the lock member 43 anticlockwise as viewed in FIG. 6. The lock member 43 urged by the spring 47 is brought into such a posture that the rotation portion 431 stands in the vertical direction. This posture is hereinafter referred to as a first posture S1.

The first protruding portion 441 and the second protruding portion 442 are protrusions extending downward from the inner surface of the cassette storage unit 42. The first protruding portion 441 corresponds to a "first regulation member", and the second protruding portion 442 corresponds to a "second regulation member" in the appended claims. Each of the first protruding portion 441 and the second protruding portion 442 has an inclined surface inclined downward from the front to the rear, and also has a vertical surface at the rear end. Each of the first protruding portion 441 and the second protruding portion 442 is configured to engage with the hook portion 433 of the lock member 43. The first protruding portion 441 is provided on the inner side (rear side) of the cassette storage unit 42, while the second protruding portion 442 is provided close to an opening (front side) of the cassette storage unit 42. As illustrated in FIG. 5, the protruding length of the first protruding portion 441 from the inner surface of the cassette storage unit 42 is smaller than that length of the second protruding portion 442.

The operation unit 45 is a member for rotating the lock member 43. The operation unit 45 includes an operation lever 450, a first pin 451, a second pin 452, a holding portion 453, a limiting portion 454, a stopper portion 455, a first contacting portion 456, and a second contacting portion 457.

The operation lever 450 shifts frontward and rearward with respect to the paper cassette 41 along the outer surface of the left or right side plate of the recording paper storage portion 412. The operation lever 450 is a beam-shaped member extending in the front-rear direction, and has a rear portion divided into upper and lower parts. A front part of the operation lever 450 penetrates the front cover 411 such that a front end of the operation lever 450 protrudes from the front cover 411 to the outside.

The first pin 451 is cylindrical, and provided on the lower part corresponding to the lower one of the upper and lower parts divided at the rear portion of the operation lever 450. The first pin 451 corresponds to a "first contact portion" in the appended claims. The first pin 451 comes into contact with a part of the rotation portion 431 of the lock member 43 below the rotation shaft 417 by sliding of the operation lever 450. The first pin 451 contacts the rear side of the rotation portion 431.

The second pin 452 is cylindrical, and provided on the upper part corresponding to the lower of the upper and lower parts divided at the rear portion of the operation lever 450. The second pin 452 corresponds to a "second contact portion" in the appended claims. The second pin 452 comes into contact with a part of the rotation portion 431 of the lock member 43 above the rotation shaft 417 by sliding of the operation lever 450. The second pin 452 is so disposed as to contact the front side of the rotation portion 431.

The holding portion 453 is held by a hand of an operator at the time of a shift of the operation unit 45, i.e., the operation lever 450 in the front-rear direction. As illustrated in FIG. 4, the holding portion 453 connects tips of the respective operation levers 450 disposed on the left and right sides of the paper cassette 41. The holding portion 453 is exposed to the outside of the drawer unit 4. The holding portion 453 also functions as a handle held for drawing the paper cassette 41 from the cassette storage unit 42. Another handle is further provided on the front cover 411 to be held for detachment of the paper cassette 41 from the cassette storage unit 42.

The limiting portion 454 extends in the direction crossing the shift direction of the operation lever 450 at right angles. The limiting portion 454 contacts the first contacting portion 456 or the second contacting portion 457 to limit a shift of the operation unit 45, i.e., the operation lever 450 in the front-rear direction. The first contacting portion 456 and the second contacting portion 457 stand on the outer surface of the side plate of the recording paper storage portion 412. The first contacting portion 456 is provided on the front side with respect to the limiting portion 454, and brought into contact with the limiting portion 454 to limit the frontward shift of the operation unit 45. On the other hand, the second contacting portion 457 is provided on the rear side with respect to the limiting portion 454, and brought into contact with the limiting portion 454 to limit the rearward shift of the operation unit 45. In other words, the first contacting portion 456 contacts the limiting portion 454 to limit a shift amount of the operation lever 450 in the frontward direction. The second contacting portion 457 contacts the limiting portion 454 to limit a shift amount of the operation lever 450 in the rearward direction.

The rail 46 is provided inside the cassette storage unit 42, and extends in the shift direction of the paper cassette 41, i.e., in the front-rear direction. The rail 46 guides a shift of the paper cassette 41 in the front-rear direction. As illustrated in FIG. 5, the rail 46 contacts the bottom plate 413 of the recording paper storage portion 412 of the paper cassette 41 to guide sliding of the paper cassette 41. The manner of guiding is not limited to the contact with the bottom plate 413 of the paper cassette 41 adopted in this embodiment. For example, the guiding may be achieved by contact with an upper portion of the side plate of the recording paper storage portion 412 as well. Alternatively, the guiding may be achieved by a configuration connected with a guard member provided on the side plate of the recording paper storage portion 412. A wheel-shaped member may be used to reduce friction produced at the time of a shift.

The stopper portion 455 is provided at a rear end of the operation lever 450. The upper part of the rear portion of the operation lever 450 is inclined downward toward the rear. The end of the inclined portion extends toward the rear. The stopper portion 455 provided at the rear end of the operation lever 450 comes into contact with the tip of the lever portion 432 of the lock member 43 at the time of rotation of the lock member 43. This contact regulates further rotation of the lock member 43.

<Drawing Operation>

Hereinafter described with reference to FIGS. 5 through 11 are lock and unlock of the paper cassette 41 of the drawer unit 4. FIG. 5 illustrates a state that the paper cassette 41 is stored in the cassette storage unit 42. The position of the paper cassette 41 in this state is hereinafter referred to as a first position PS1.

As illustrated in FIGS. 5 and 6, a part of the lock member 43 above the rotation shaft 417 is urged by the spring 47 toward the front, i.e., in an anticlockwise direction as viewed in FIG. 6 when the operation unit 45 is not operated at the first position PS1 of the paper cassette 41. In the following description, a rotation direction of the upper portion of the lock member 43 toward the front is referred to as an anticlockwise direction, while a rotation direction of the upper portion of the lock member 43 toward the rear is referred to as a clockwise direction. The lock member 43 is thus maintained in the first posture S1. In this case, the hook portion 433 is pressed by the spring 47 against the first protruding portion 441, whereby a shift of the paper cassette 41 toward the front is regulated by engagement between the hook portion 433 and the first protruding portion 441. In other words, the paper cassette 41 is locked at the first position PS1 by the lock member 43. The force of the spring 47 to press the lock member 43 is sufficient for regulating the shift of the paper cassette 41 when the operation unit 45 is not operated.

For example, the paper cassette 41 may be drawn from the cassette storage unit 42 for replenishment of recording paper in the recording paper storage portion 412 of the paper cassette 41 or for other purposes. Discussed next is an action for drawing the paper cassette 41 from the cassette storage unit 42 in the first position PS1. When the operator pulls the holding portion 453 toward the front, the operation unit 45, i.e., the operation lever 450 shifts toward the front. (This operation is referred to as a first operation OP1). The lock member 43 is kept urged anticlockwise by the spring 47. Accordingly, the paper cassette 41 is not easily drawn out even when the operator accidentally touches the operation unit 45.

In response to the first operation OP1 performed for the operation unit 45, the first pin 451 presses the lower part of the rotation portion 431 of the lock member 43 toward the front. When force of the first pin 451 for pressing the lower part of the rotation portion 431 of the lock member 43 becomes larger than the force of the spring 47, the lock member 43 rotates clockwise around the rotation shaft 417.

In this case, a frontward shift of the operation lever 450 is limited by contact between the limiting portion 454 and the first contacting portion 456 as illustrated in FIG. 7. As a result, the lock member 43 rotates to a second posture S2 by rotation of the lock member 43 in the clockwise direction (corresponding to a "predetermined direction" in the appended claims) from the first posture S1. As illustrated in FIGS. 7 and 8, an upper end of the hook portion 433 of the lock member 43 shifts to a position below a lower end of the first protruding portion 441 in accordance with rotation of the lock member 43 to the second posture S2. As a result, engagement between the hook portion 433 and the first protruding portion 441, i.e., lock of the paper cassette 41 at the first position PS1 is canceled. In addition, a tip of the lever portion 432 of the lock member 43 contacts the stopper portion 455 provided at the rear end of the operation lever 450. This contact limits further clockwise rotation of the lock member 43.

When the lock member 43 comes into the second posture S2, the paper cassette 41 is allowed to shift toward the front from the first position PS1. The not-shown handle is provided on the front cover 411 of the paper cassette 41. The operator is allowed to hold this handle and shift the paper cassette 41 toward the front in the second posture S2 of the lock member 43. In this case, the operator performs the first operation OP1 for the operation unit 45, and also pulls the handle to draw the paper cassette 41 from the cassette storage unit 42. Note that the first operation OP1 is an operation for pulling the operation unit 45 in a draw-out direction of the paper cassette 41. The operation unit 45 and the paper cassette 41 are connected to each other via contact between the limiting portion 454 and the first contacting portion 456. Accordingly, a frontward shift of the paper cassette 41 may be achieved by the first operation OP1 performed by the operator.

When the lock member 43 is in the second posture S2, the upper end of the hook portion 433 of the lock member 43 comes to a position above the lower end of the second protruding portion 442 having a longer protrusion length than that of the first protruding portion 441. In this case, the hook portion 433 comes into contact with the second protruding portion 442 when the paper cassette 41 is drawn out in the second posture S2 of the lock member 43. The tip of the lever portion 432 contacts the stopper portion 455 to limit clockwise rotation of the lock member 43. Accordingly, a frontward shift of the paper cassette 41 is regulated at the position of contact between the hook portion 433 and the second protruding portion 442, i.e., locked at that position (see FIG. 9).

The position of the paper cassette 41 in the state of engagement between the hook portion 433 of the lock member 43 in the second posture S2 and the second protruding portion 442 is hereinafter referred to as a second position PS2. The second position PS2 is such a position that the paper cassette 41 does not separate when a specified number of sheets of recording paper are stored in the paper cassette 41. In other words, the position of the second protruding portion 442 is determined such that the paper cassette 41 stops at a position not causing separation when the specified number of sheets of recording paper are stored in the paper cassette 41.

When the paper cassette 41 is located at the second position PS2, the operator may release the hand from the holding portion 453 for supply of paper or other purposes. In this case, the lock member 43 rotates anticlockwise by the urging force of the spring 47, and returns to the first posture S1. The protrusion length of the second protruding portion 442 is larger than that length of the first protruding portion 441, wherefore the lock member 43 engages with the hook portion 433 in the first posture S1 of the lock member 43. When the rotation portion 431 presses the first pin 451 toward the rear in accordance with return of the lock member 43 to the first posture S1, the operation unit 45 shifts toward the rear accordingly. The paper cassette 41 slightly shifts toward the rear in accordance with anticlockwise rotation of the lock member 43. However, the amount of this shift is small enough to produce no effect on the replenishment operation of recording paper. In addition, the strength of the spring 47 may be determined such that the lock member 43 is maintained at the second posture S2 by the weight of the paper cassette 41 even in a state that no recording paper is stored in the paper cassette 41 (empty state).

In case of ordinary supply of paper, the paper cassette 41 is returned to the cassette storage unit 42 after completion of storage of recording paper in the paper cassette 41. More specifically, the paper cassette 41 shifts toward the rear in accordance with an operation by the operator. In this case, the lock member 43 returns to the first posture S1 by the force of the spring 47.

With approach of the paper cassette 41 to the first position PS1, the hook portion 433 of the lock member 43 comes into contact with the first protruding portion 441. More specifically, the inclined surface of the hook portion 433 contacts the inclined surface of the first protruding portion 441. When the paper cassette 41 shifts toward the rear in this state, the inclined surface of the hook portion 433 is pressed downward by the inclined surface of the first protruding portion 441. The force of the first protruding portion 441 for pressing the hook portion 433 acts on the lock member 43 as force for rotating the lock member 43 in the clockwise direction. The lock member 43 rotates until the upper end of the hook portion 433 comes to a position below the lower end of the first protruding portion 441. As a result, the hook portion 433 shifts to the rear of the first protruding portion 441.

The hook portion 433 having shifted to the rear of the first protruding portion 441 comes into a state not further pressed by the first protruding portion 441. In this state, the force for rotating the lock member 43 clockwise is released from the lock member 43. The lock member 43 is rotated anticlockwise by the force of the spring 47. When the paper cassette 41 reaches the first position PS1, the lock member 43 comes into the first posture S1. In this posture, the paper cassette 41 is locked to the first position PS1 by engagement between the hook portion 433 and the first protruding portion 441.

On the other hand, the paper cassette 41 may be detached from the cassette storage unit 42 for maintenance of the image forming apparatus or removal of recording paper jammed in the course of conveyance. Procedures for detaching the paper cassette 41 from the cassette storage unit 42 are hereinafter described. Procedures for drawing the paper cassette 41 from the first position PS1 to the second position PS2 are performed in a manner similar to the corresponding procedures described above.

When the holding portion 453 is pressed by the operator toward the rear in the state that the paper cassette 41 is located at the second position PS2 as illustrated in FIGS. 10 and 11, the operation unit 45, i.e., the operation lever 450 shifts to the rear. This operation is hereinafter referred to as a second operation OP2. By the second operation OP2 performed for the operation unit 45, the second pin 452 of the operation lever 450 contacts a part of the rotation portion 431 above the rotation shaft 417 from the front. The second pin 452 presses the rotation portion 431 by the second operation OP2 to rotate the lock member 43 clockwise.

The operation lever 450 shifts toward the rear until the limiting portion 454 contacts the second contacting portion 457. When the limiting portion 454 contacts the second contacting portion 457, the lock member 43 pressed by the second pin 452 further rotates clockwise from the second posture S2. The posture of the lock member 43 in this condition is hereinafter referred to as a third posture S3. The lock member 43 in the third posture S3 is positioned such that the upper end of the hook portion 433 is located below the lower end of the second protruding portion 442. The paper cassette 41 is shifted to the front in this state, and detached from the cassette storage unit 42.

Rotation of the lock member 43 and a shift amount of the operation lever 450 are hereinafter described. A rotation amount (posture) of the lock member 43 is determined by a shift amount of the operation lever 450 in the front-rear direction. It is assumed that the operation lever 450 is located at a neutral position in a state not operating the operation lever 450, i.e., in the first posture S1 of the lock member 43. The lock member 43 comes into the second posture S2 when the limiting portion 454 is brought into contact with the first contacting portion 456 by a frontward shift of the operation lever 450. On the other hand, the lock member 43 comes into the third posture S3 when the limiting portion 454 is brought into contact with the second contacting portion 457 by a rearward shift of the operation lever 450. It is therefore understood that the rotational operation of the lock member 43 performed via the operation lever 450 switches the first posture S1 to the second posture S2, or switches the first posture S1 to the third posture S3. In addition, the rotation amount of the lock member 43 for switching to the third posture S3 is larger than the rotation amount for switching to the second posture S2. The shift amount of the operation lever 450 toward the front required until the limiting portion 454 contacts the first contacting portion 456 from the neutral position is smaller than the shift amount required until the limiting portion 454 contacts the second contacting portion 457 from the neutral position.

For detaching the paper cassette 41 from the cassette storage unit 42, the lock member 43 is initially rotated to the second posture S2 by performing the first operation OP1 for the operation unit 45. Thereafter, the lock member 43 is rotated to the third posture S3 by performing the second operation OP2. The first operation OP1 is an operation for shifting the operation lever 450 toward the front, while the second operation OP2 is an operation for shifting the operation lever 450 toward the rear. Accordingly, the lock member 43 temporarily returns to the first posture S1 from the second posture S2, and then rotates clockwise to shift to the third posture S3 by the second operation OP2 performed after the first operation OP1. When the lock member 43 is in the second posture S2, the tip of the lever portion 432 contacts the stopper portion 455 to limit further clockwise rotation of the lock member 43. In this condition, the operation lever 450 is located at the front end. During the second operation OP2 performed for the operation unit 45, the lock member 43 forms the same angle as the angle of the second posture S2. In this case, however, the lock member 43 is allowed to further rotate to the third posture S3 from the second posture S2 in the state that the stopper portion 455 is positioned on the rear side.

As described above, the paper cassette 41 is unlocked at the first position PS1 by performing the first operation OP1 for the operation unit 45. In the first operation OP1, the holding portion 453 is operated in the same direction as the direction of the drawing operation of the paper cassette 41 (pulling operation toward the front). Accordingly, the operation for drawing from the first position PS1 is easily and instinctively understood by the operator.

On the other hand, the second operation OP2 needs to be performed for the operation unit 45 for detachment of the paper cassette 41 from the second position PS2 to the outside of the cassette storage unit 42. As described above, the second operation OP2 is an operation for shifting the operation unit 45 in the direction opposite to the frontward direction, i.e., the direction for drawing the paper cassette 41. In this case, an operation other than the first operation OP1 performed for the operation unit 45 (such as urging operation for raising the operation unit 45 upward) during draw-out of the paper cassette 41 is different from the second operation OP2. The operator therefore consciously switches the first operation OP1 to the second operation OP2. Accordingly, detachment of the paper cassette 41 from the cassette storage unit 42 against an intention of the operator decreases.

According to the drawer unit 4 of this embodiment of the present invention, the operator instinctively draws out the paper cassette 41, but consciously detaches the paper cassette 41 from the cassette storage unit 42 as described above. Accordingly, accidental detachment of the paper cassette 41 to the outside decreases.

<Second Embodiment>

Figure 12:
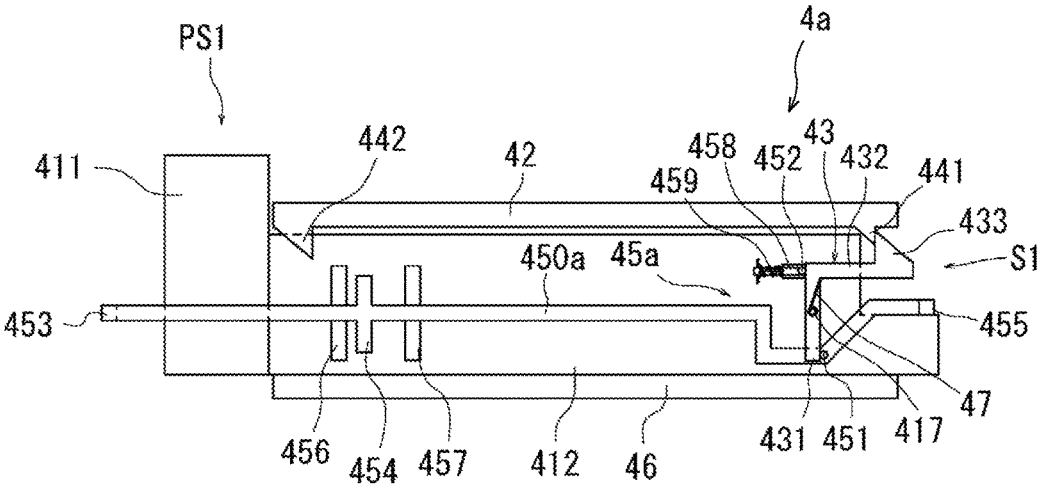
FIG. 12 is a schematic view of a drawer unit when a paper cassette is located at a first position according to another embodiment of the present invention.
Figure 13:
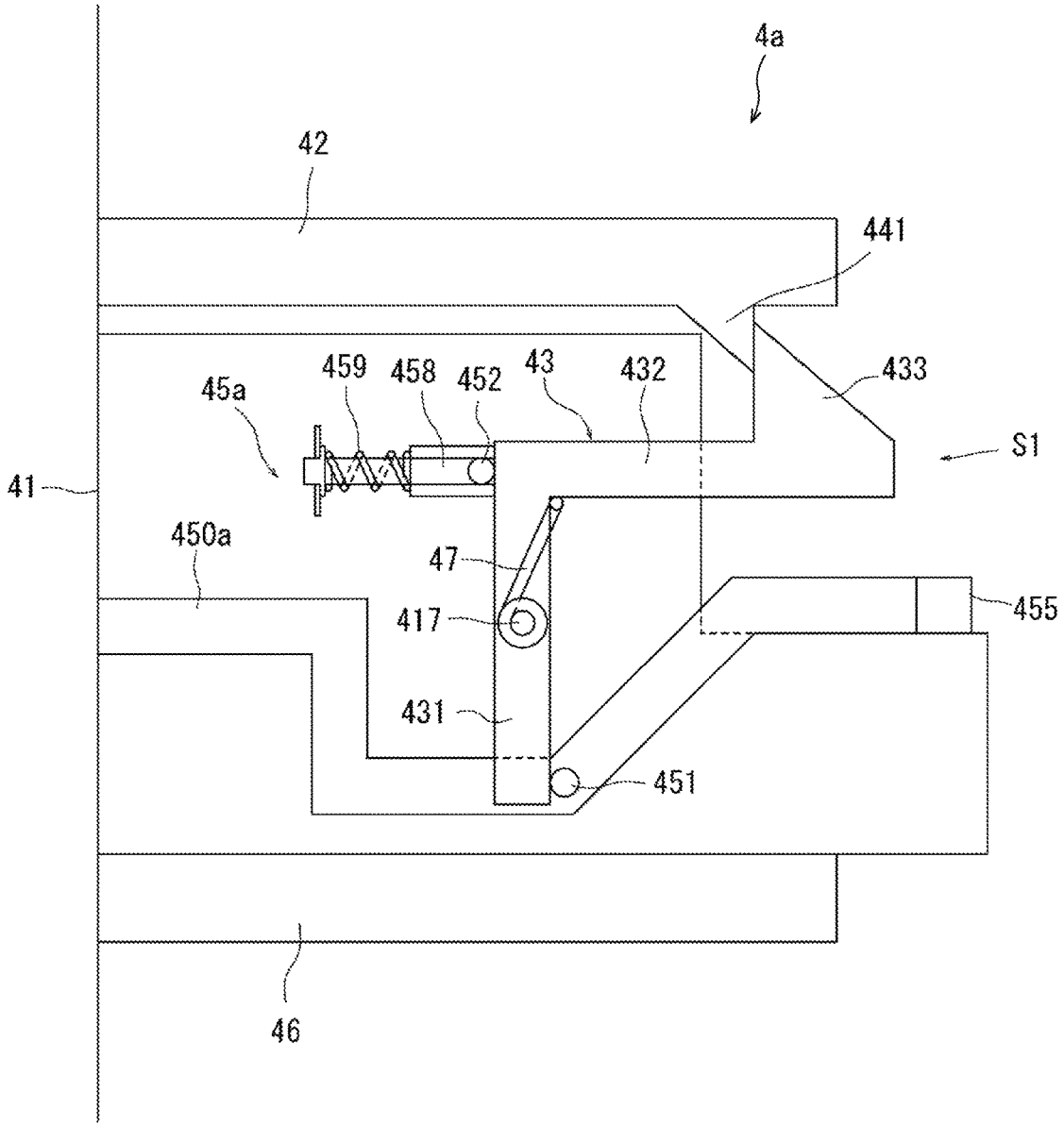
FIG. 13 is an enlarged view of a lock member of the drawer unit illustrated in FIG. 12.
Figure 14:
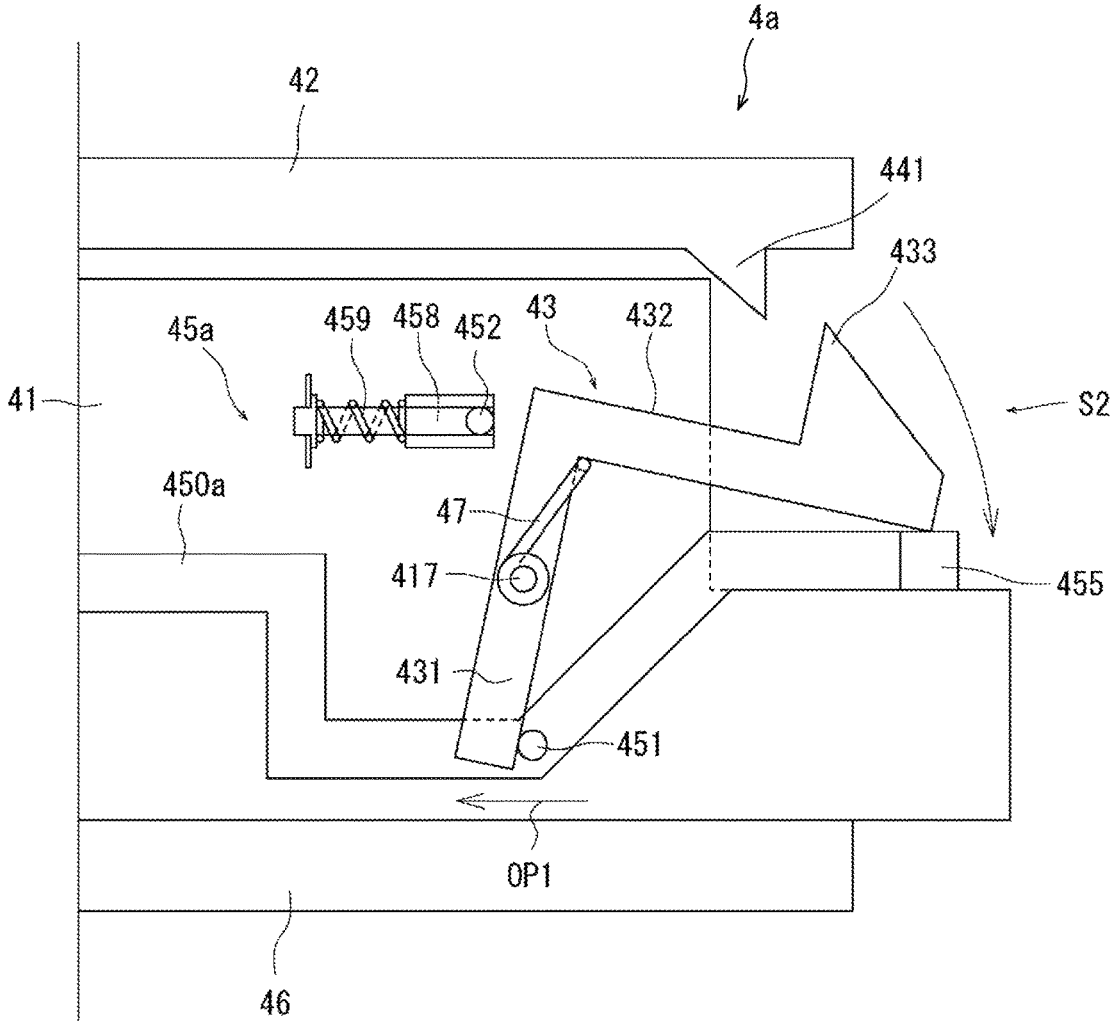
FIG. 14 is an enlarged view of the lock member of the drawer unit when the lock member is in a second posture.
Figure 15:
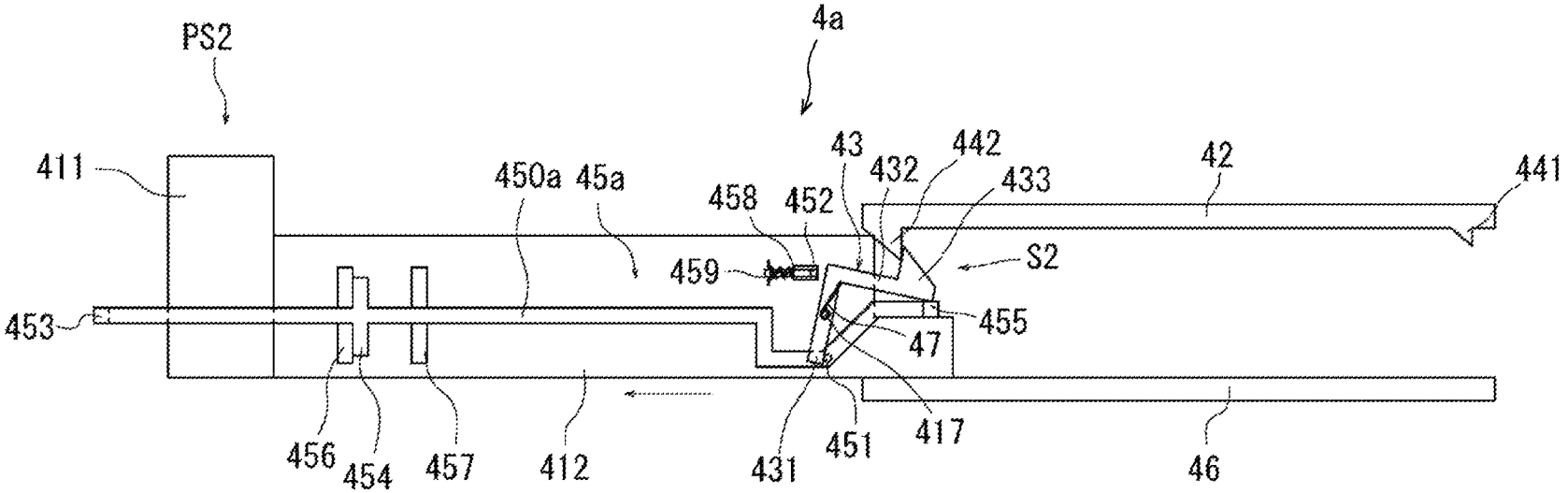
FIG. 15 is a schematic view of the second posture of the lock member and a second position of a drawer member.
Figure 16:
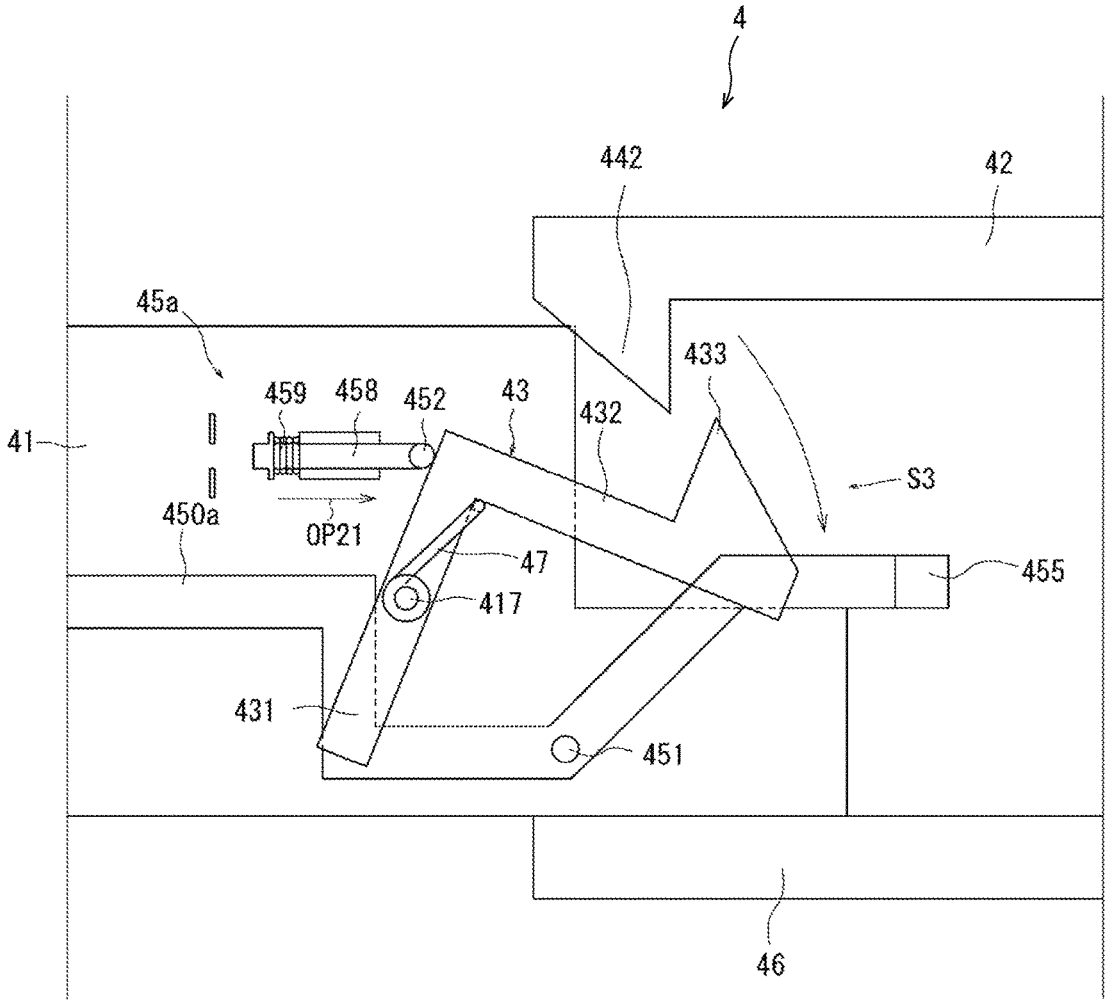
FIG. 16 is an enlarged view of the lock member of the drawer unit when the lock member is in a third posture.

A drawer unit according to a different embodiment of the present invention is hereinafter described. FIG. 12 is a schematic view illustrating a state that a paper cassette is located at a first position according to the drawer unit of the different embodiment of the present invention. FIG. 13 is an enlarged view of a lock member of the drawer unit illustrated in FIG. 12. FIG. 14 is an enlarged view of the lock member of the drawer unit in a second posture of the lock member. FIG. 15 is a schematic view illustrating the second posture of the lock member and a second position of a drawer member. FIG. 16 is an enlarged view of the lock member of the drawer unit when the lock member is in a third posture.

A drawer unit 4*a* according to this embodiment has a configuration similar to the configuration of the drawer unit 4 except that a different operation lever 450*a* is provided on an operation unit 45*a*, and that a sliding operation member 458 and a support member 459 are provided. Accordingly, parts of the drawer unit 4*a* similar to the corresponding parts of the drawer unit 4 have been given similar reference numbers, and detailed description of the similar parts is not repeated herein.

As illustrated in FIGS. 12 and 13, the operation lever 450*a* of the operation unit 45*a* of the drawer unit 4*a* has a rear portion bent downward, and further includes the first pin 451 for pressing a part of the rotation portion 431 of the lock member 43 below the rotation shaft 417, and includes the stopper portion 455 disposed at the rear end.

In addition, the operation unit 45*a* includes the sliding operation member 458 and the support member 459. The support member 459 is a protrusion provided on the outer surface of the side plate of the recording paper storage portion 412. The support member 459 guides sliding movement of the sliding operation member 458, and also regulates a shift of the sliding operation member 458. Moreover, the support member 459 includes a spring for returning the sliding operation member 458 to a predetermined position.

The sliding operation member 458 is supported by the support member 459 in a manner slidable frontward and rearward along the outer surface of the side plate of the recording paper storage portion 412. The second pin 452 is provided at the rear end of the sliding operation member 458. The second pin 452 has a configuration similar to the configuration of the second pin 452 of the drawer unit 4. The second pin 452 is capable of contacting and pressing a front portion of the rotation portion 431 of the lock member 43 above the rotation shaft 417. The sliding operation member 458 further includes a protrusion which extends along the outer surface of the side plate of the recording paper storage portion 412, and crossing the sliding direction at right angles. A shift of the sliding operation member 458 is regulated by contact between this protrusion and the support member 459. The sliding operation member 458 is pressed toward the front by the spring included in the support member 459. The sliding operation member 458 is located at this position when no operation is performed by the operator.

As illustrated in FIGS. 12 and 13, the first pin 451 contacts the rear part of the rotation portion 431 below the rotation shaft 417 in the first posture S1 of the lock member 43. In this state, the second pin 452 contacts the front part of the rotation portion 431 above the rotation shaft 417. At least either the first pin 451 or the second pin 452 may be separated from the rotation portion 431 in the first posture S1 of the lock member 43.

When the first operation OP1 is performed for the operation unit 45*a*, i.e., the holding portion 453, the operation lever 450*a* shifts toward the front. The first pin 451 presses the rotation portion 431 accordingly. As a result, the lock member 43 rotates clockwise to come into the second posture S2 (see FIG. 14). In this state, the second pin 452 provided on the sliding operation member 458 is separated from the rotation portion 431.

In the second posture S2 of the lock member 43, the paper cassette 41 is movable toward the front, wherefore the hook portion 433 shifts to the second position PS2 for engaging with the second protruding portion 442 (see FIG. 15). For detaching the paper cassette 41 from the cassette storage unit 42, the operator temporarily releases the hand from the holding portion 453 and operates the sliding operation member 458 provided on the outside of each of the left and right side surfaces of the recording paper storage portion 412. In this case, operation force of the operator does not act on the operation lever 450*a*, wherefore the lock member 43 returns to the first posture S1 by elastic force of the spring 47. In addition, the first pin 451 is pressed by the rotation portion 431, whereby the operation lever 450*a* also shifts toward the rear.

When the sliding operation member 458 is shifted toward the rear by the operator, the second pin 452 provided on the sliding operation member 458 presses the part of the rotation portion 431 above the rotation shaft 417 toward the rear. According to the drawer unit 4*a* of this embodiment, the operation for pressing the sliding operation member 458 toward the rear corresponds to a second operation OP21. The lock member 43 rotates clockwise by the second operation OP21, and comes into the third posture S3. The rotation amount of the lock member 43 is determined by the shift amount of the sliding operation member 458. Accordingly, the sliding operation member 458 shifts by an amount sufficient for rotating the lock member 43 to the third posture S3. Thereafter, the operator holds the side plates of the recording paper storage portion 412 while pressing the sliding operation member 458, and detaches the paper cassette 41 from the cassette storage unit 42.

As described above, the operation unit 45*a* includes the operation lever 450*a* and the sliding operation member 458. In this case, the operator is allowed to instinctively perform the first operation OP1 to shift the paper cassette 41 from the first position PS1 to the second position PS2. For detaching the paper cassette 41 from the cassette storage unit 42, the second operation OP21 different from the first operation OP1 needs to be performed. In this case, the operator consciously performs the operation for detaching the paper cassette 41 from the cassette storage unit 42. Accordingly, detachment of the paper cassette 41 against an intention of the operator decreases.

Features other than above are similar to the corresponding features of the first embodiment.

<Third Embodiment>

Figure 17:
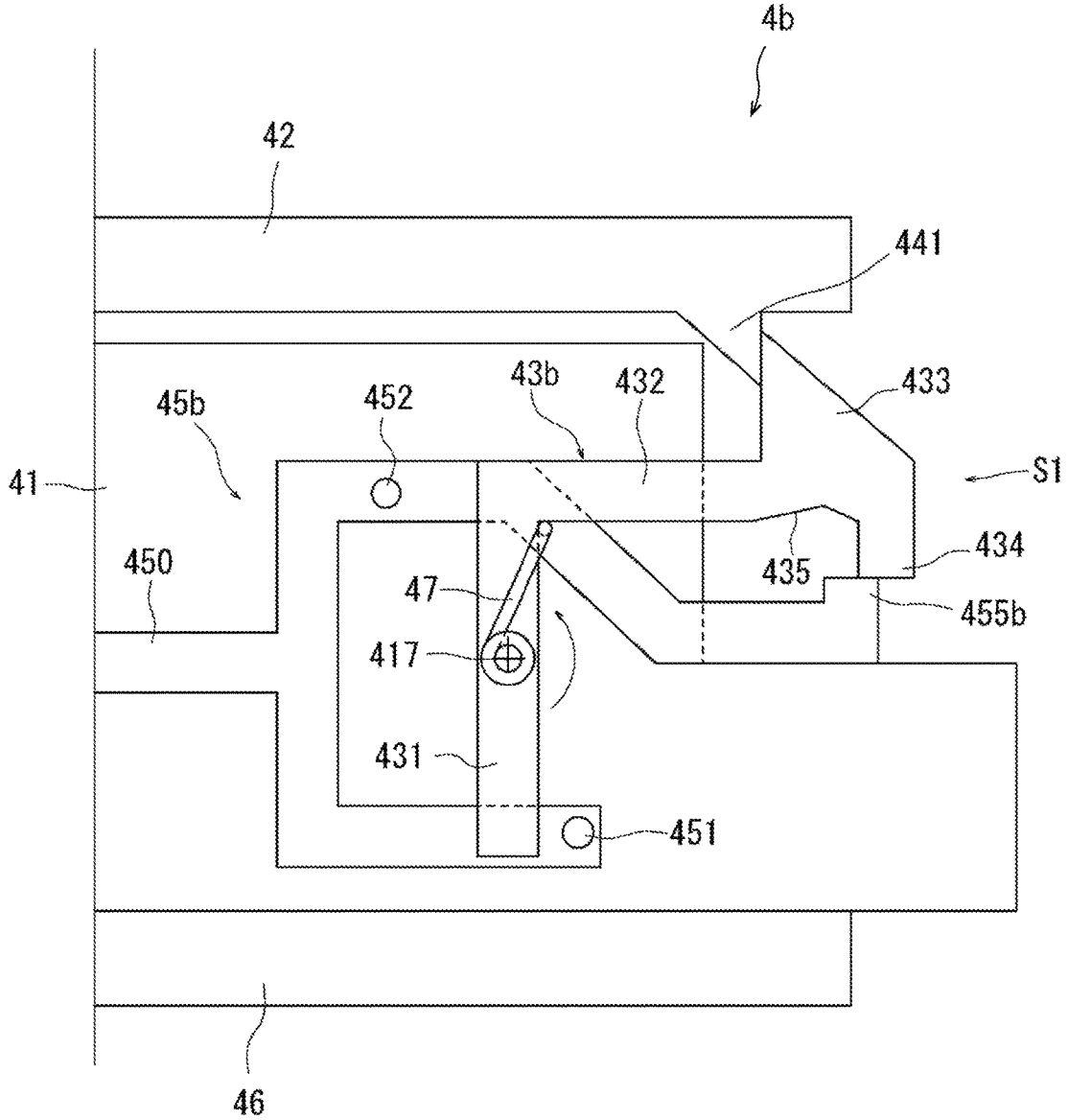
FIG. 17 is an enlarged view of a lock member of a drawer unit when a paper cassette is located at a first position according to a further embodiment of the present invention.
Figure 18:
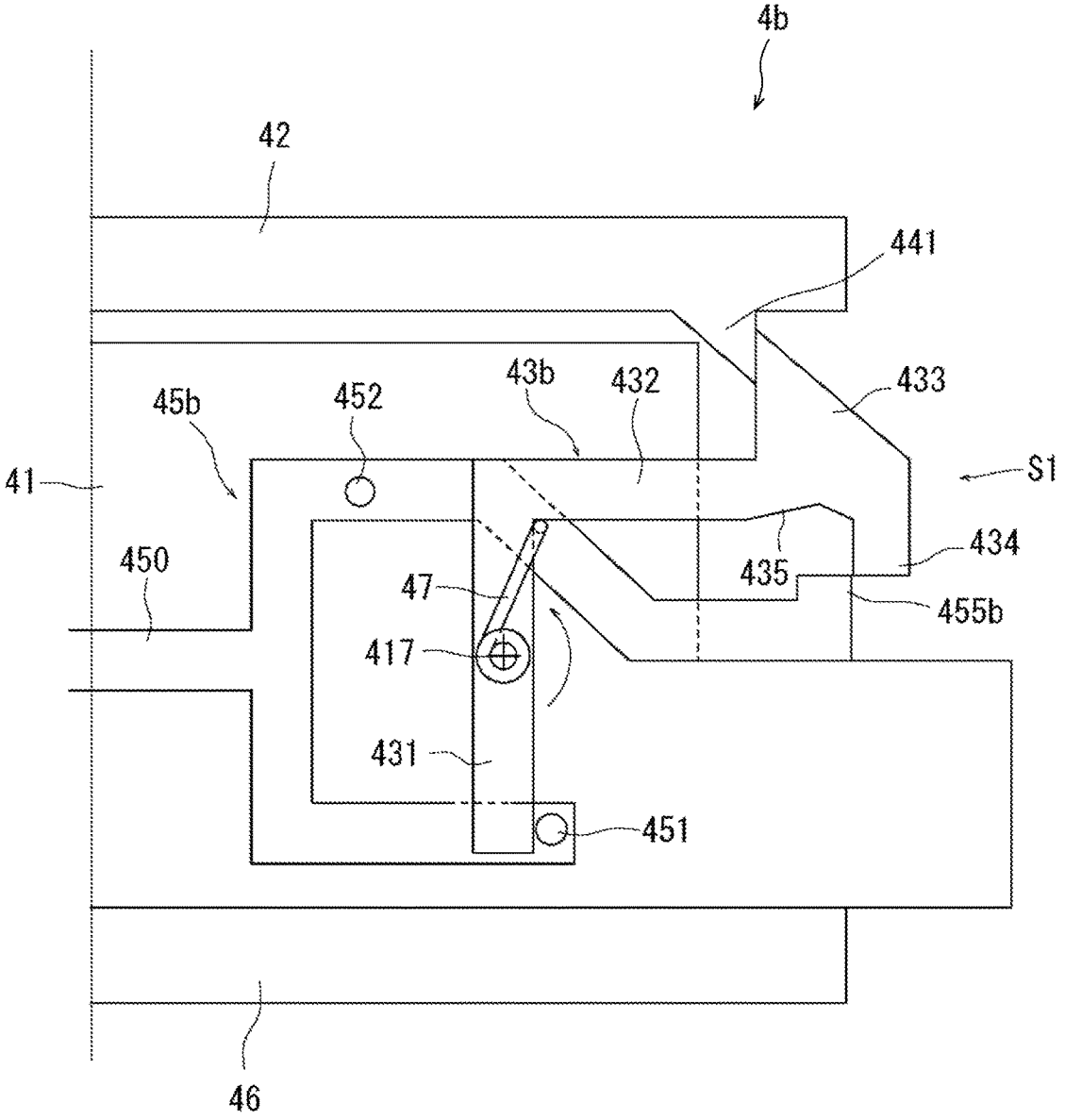
FIG. 18 is an enlarged view of a lock member when a first pin contacts a rotation portion.
Figure 19:
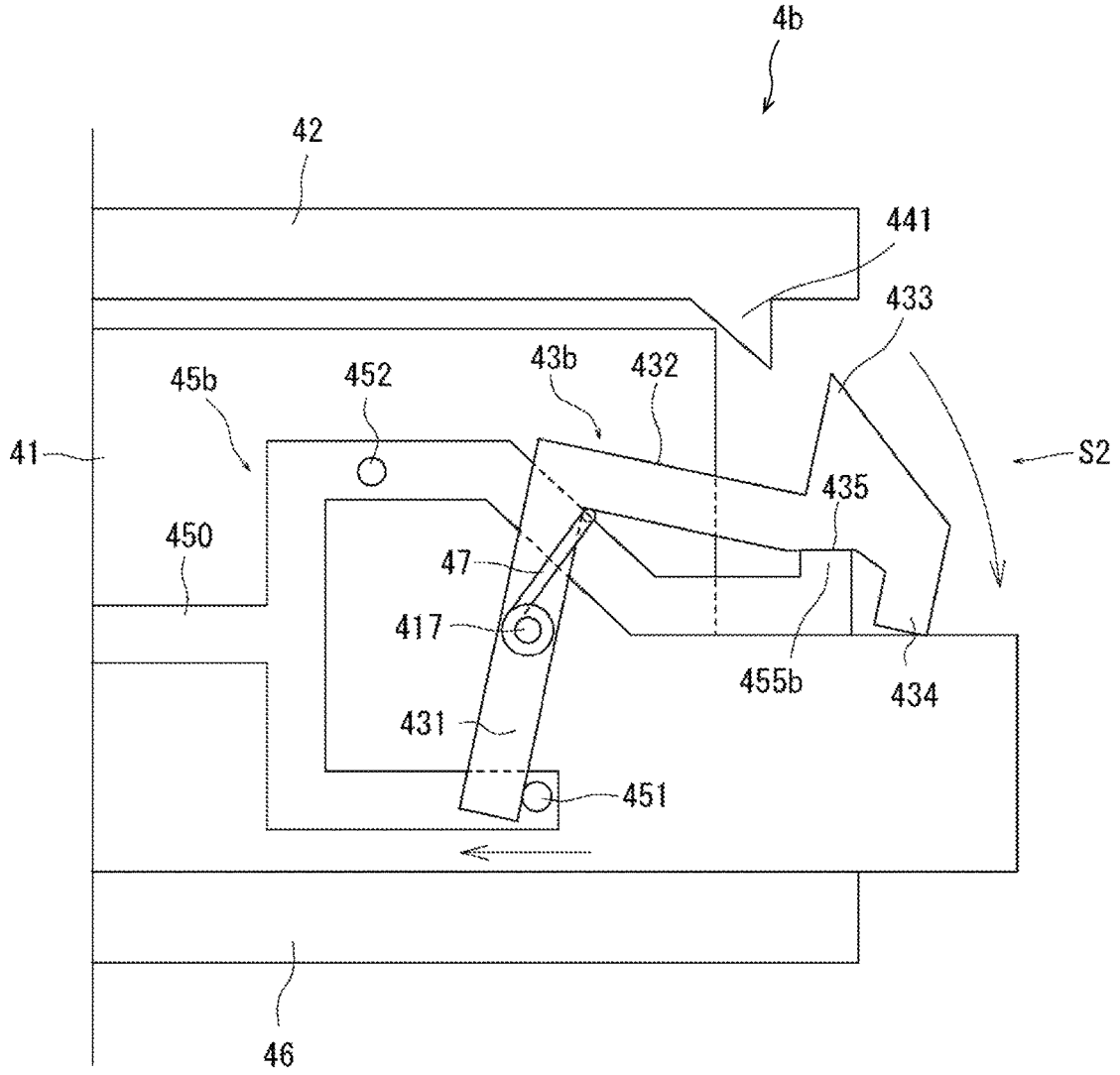
FIG. 19 is an enlarged view of the lock member of the drawer unit when the lock member is in a second posture.
Figure 20:
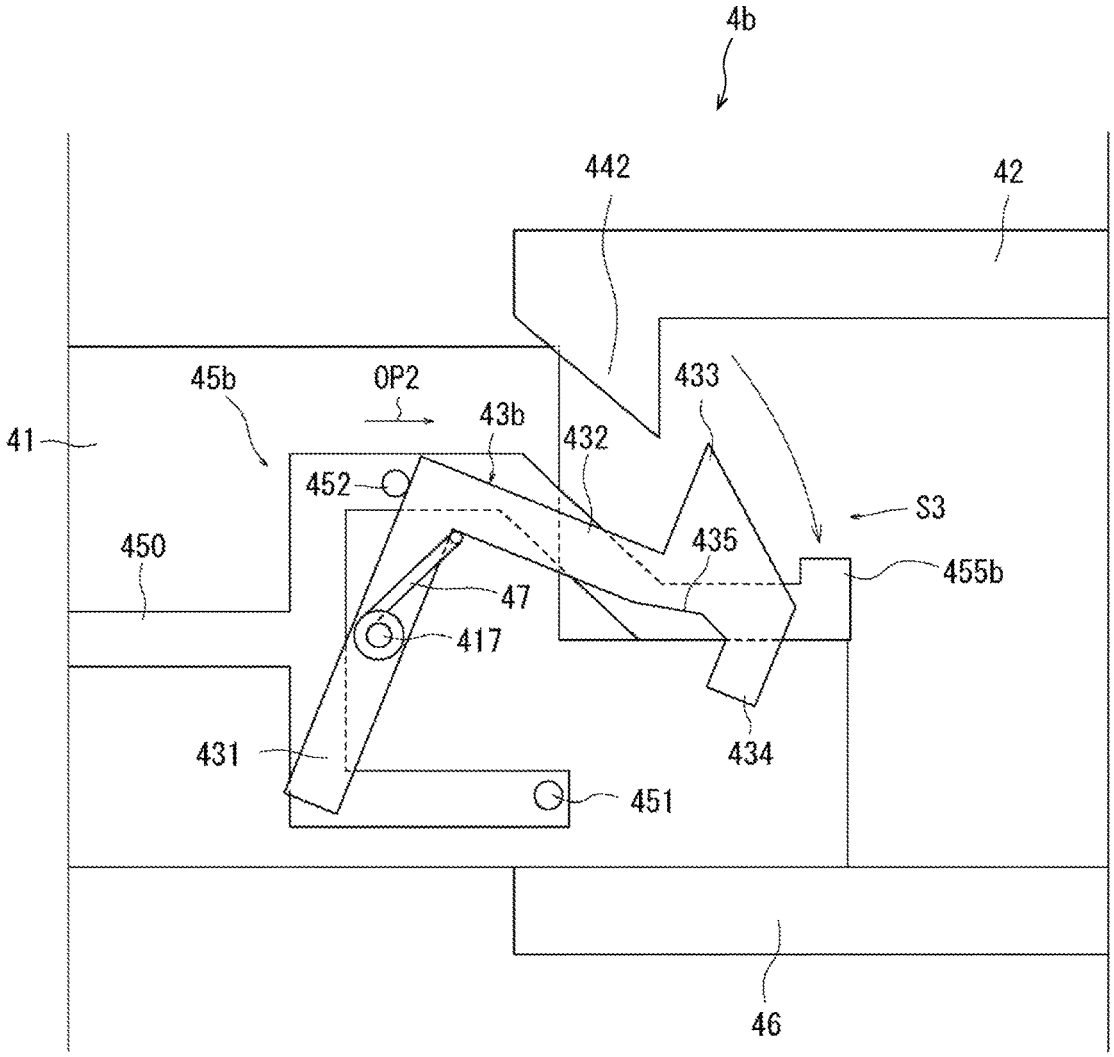
FIG. 20 is an enlarged view of the lock member of the drawer unit when the lock member is in a third posture.

A drawer unit according to a different embodiment of the present invention is hereinafter described. FIG. 17 is an enlarged view of a lock member in a state that a paper cassette is located at a first position according to a drawer unit of a further different embodiment of the present invention. FIG. 18 is an enlarged view of the lock member in a state that a first pin contacts a rotation portion. FIG. 19 is an enlarged view of the lock member of the drawer unit when the lock member is in a second posture. FIG. 20 is an enlarged view of the lock member of the drawer unit when the lock member is in a third posture. A drawer unit 4*b* according to this embodiment is different from the drawer unit 4 in that a different stopper portion 455*b* is provided on an operation unit 45*b*, and that a lock member 43*b* includes a rotation limiting protrusion 434 and a rotation limiting recess 435. Other configurations are similar to the corresponding configurations of the drawer unit 4. Similar parts have been given similar reference numbers, and detailed description of the same parts is not repeated herein.

As illustrated in FIG. 17, the stopper portion 455*b* extends upward from the rear end of an operation lever 450*b*. The rotation limiting protrusion 434 of the lock member 43*b* extends from the tip of the lever portion 432 toward the side opposite to the hook portion 433. The rotation limiting recess 435 is disposed adjacent to the rotation limiting protrusion 434 of the lever portion 432, and has a slope part.

The lock member 43*b* of the drawer unit 4*b* is in the first posture S1 when the paper cassette 41 is located at the first position PS1 (see FIG. 5 and others). According to the drawer unit 4*b*, the rotation limiting protrusion 434 and the stopper portion 455*b* come into contact with each other when the lock member 43*b* is in the first posture S1 as illustrated in FIG. 17. This contact regulates clockwise rotation of the lock member 43*b*. According to this configuration, clockwise rotation of the lock member 43*b* is more firmly locked when the paper cassette 41 is located at the first position PS1 in comparison with the configuration which regulates clockwise rotation of the lock member 43*b* only by the force of the spring 47. For example, the paper cassette 41 is not drawn out even when the not-shown handle of the front cover 411 is operated instead of the operation unit 45*b*.

When the lock member 43*b* is in the first posture S1, the first pin 451 is disposed at a position shifted from the rotation portion 431 toward the rear as illustrated in FIG. 17. When the operation lever 450*b* shifts toward the front by the first operation OP1, the first pin 451 comes into contact with a rear part of the rotation portion 431 below the rotation shaft 417 as illustrated in FIG. 18. In this case, the stopper portion 455*b* also shifts toward the front. As a result, the rotation limiting protrusion 434 of the lock member 43*b* and the stopper portion 455*b* are separated from each other, wherefore regulation of clockwise rotation of the lock member 43*b* is canceled. The operation lever 450*b* further shifts toward the front in this condition. Accordingly, the first pin 451 presses the rear part of the rotation portion 431 below the rotation shaft 417 toward the front, whereby the lock member 43*b* rotates clockwise. According to this embodiment, the contact between the first pin 451 and the rotation portion 431 and the separation between the stopper portion 455*b* and the rotation limiting protrusion 434 are caused at the same timing. However, these contact and separation need not be caused at the same timing. For securing safety, the contact between the first pin 451 and the rotation portion 431 may be made by further sliding of the operation lever 450*b* toward the front after separation between the stopper portion 455*b* and the rotation limiting protrusion 434.

When the lock member 43*b* shifts to the second posture S2, the stopper portion 455*b* comes into contact with the rotation limiting recess 435. This contact limits clockwise rotation of the lock member 43*b*. According to this embodiment, the rotation limiting recess 435 has a slope to allow contact with the upper surface of the stopper portion 455*b* having a rectangular parallelepiped shape. However, other configurations may be adopted. For example, the rotation limiting recess 435 is not required to have a recess shape as long as a contacting portion is provided for this contact. In addition, the slope may be eliminated even when the rotation limiting recess 435 has a recess shape.

When the lock member 43*b* is in the first posture S1, the second pin 452 is disposed at the position away from a front portion of the rotation portion 431 above the rotation shaft 417. When the stopper portion 455*b* and the rotation limiting protrusion 434 are separated from each other in accordance with a rearward shift of the operation lever 450*b*, the second pin 452 contacts the front part of the rotation portion 431 above the rotation shaft 417. Similarly to the first pin 451, the second pin 452 may contact the rotation portion 431 simultaneously with separation between the stopper portion 455*b* and the rotation limiting protrusion 434, or after the rearward shift of the operation lever 450*b*.

As described above, clockwise rotation of the lock member 43*b* is regulated in the first posture S1 and the second posture S2. Accordingly, the lock member 43*b* is more securely locked in comparison with lock only by the urging force of the spring 47.

Features other than above are similar to the corresponding features of the first embodiment.

According to the respective embodiments described herein, the lock member 43 and the operation unit 45 are provided on the outer surfaces of both the side plates of the paper cassette (side surfaces of the paper cassette). However, the lock member 43 and the operation unit 45 may be provided on the outer surface of either one of the side plates. In addition, the lock member 43 and the operation unit 45 may be provided on a lower surface of a bottom plate of the paper cassette.

According to a drawer unit of an aspect of the present invention, a first operation for an operation unit is performed in the same direction as a drawing direction at the time of unlock of a paper cassette corresponding to a drawer member locked to a first position to be stored in a cassette storage unit. In this case, an operator is capable of instinctively drawing the paper cassette from the cassette storage unit. On the other hand, a second operation for the operation unit is performed in an insertion direction (opposite direction of the drawing direction) to detach the paper cassette from a second position corresponding to a draw-out position from the cassette storage unit. In this case, the operator is capable of consciously detaching the paper cassette by performing the second operation. Accordingly, detachment of the paper cassette against an intention of the operator decreases. In addition, the first operation and the second operation are opposite operations, wherefore the second operation is not easily performed by accident during the first operation performed by the operator. Accordingly, accidental detachment of the paper cassette against an intention of the operator further decreases.

While a paper cassette included in an image forming apparatus has been described as an example of the drawer unit according to the invention of the present application, the invention is applicable to a drawer unit of furniture or the like configured to include a drawer member which has a locking and unlocking structure and slides to be drawn out. In addition, while an image forming apparatus using an electrographic system has been described as an example of an image forming apparatus of the present invention, the invention is applicable to other types of image forming apparatuses, such as an image forming apparatus using an ink jet system instead of the electrographic system, as long as the drawer unit is provided. Moreover, the invention is applicable to a multifunction peripheral (MFP) which includes a copy function, a scanner function, a printer function, and a facsimile function, or is applicable to a printer, a copy machine, a facsimile machine or the like, as long as the drawer unit according to any one of the foregoing embodiments is provided. Furthermore, configurations of respective parts are not limited to the configurations depicted in the figures, but may be modified in various ways without departing from the scope of the invention of the present application.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A drawer unit comprising:

a drawer member allowed to shift toward a storage unit in an inserting direction, or shift from the storage unit in a drawing direction;

a lock member rotatably supported by the drawer member;

a first regulation member that is included in the storage unit and engages with the lock member to regulate a shift of the drawer member in the drawing direction when the drawer member is located at a first position within the storage unit;

a second regulation member that is included in the storage unit and engages with the lock member to regulate a shift of the drawer member in the drawing direction when the drawer member is located at a second position drawn from the first position; and an operation unit that receives a first operation that rotates the lock member in the drawing direction to allow engagement between the lock member and the first regulation member, and a second operation that rotates the lock member in the inserting direction to allow engagement between the lock member and the second regulation member;

wherein the lock member is allowed to engage with the first regulation member in a first posture of the lock member, is allowed to engage with the second regulation member in a second posture of the lock member rotated in a predetermined direction from the first posture, and is released from engagement with the second regulation member in a third posture of the lock member further rotated in the predetermined direction from the second posture, and the lock member is rotated to the second posture by the first operation, and rotated to the third posture by the second operation.

2. The drawer unit according to claim 1, wherein the operation unit is attached to the drawer member.

3. The drawer unit according to claim 1, wherein the operation unit includes a first contact portion that contacts and presses the lock member in the first operation, and a second contact portion that contacts and presses the lock member in the second operation, and the first contact portion and the second contact portion are disposed on sides opposite to each other with respect to a rotation center of the lock member.

4. The drawer unit according to claim 3, wherein the lock member includes a rotation portion whose intermediate portion is rotatably supported by the drawer member, a lever portion that extends from one end of the rotation portion, and a hook portion that extends in a direction opposite to the rotation portion from a tip of the lever portion, and is allowed to engage with the first regulation member or the second regulation member in accordance with a posture of the lock member, and each of the first regulation member and the second regulation member is a protrusion that protrudes toward the lock member from the storage unit.

5. The drawer unit according to claim 4, wherein the first contact portion contacts another end of the rotation portion, and the second contact portion contacts the one end of the rotation portion.

6. The drawer unit according to claim 5, wherein the operation unit is a member allowed to reciprocate in the inserting direction or the drawing direction of the drawer member, and the operation unit includes an operation lever that supports the first contact portion and the second contact portion.

7. The drawer unit according to claim 6, wherein a shift amount of the operation unit from an initial position to a shift end in the second operation is larger than a shift amount of the operation unit from an initial position to a shift end in the first operation.

8. The drawer unit according to claim 4, wherein a protrusion amount of the first regulation member is smaller than a protrusion amount of the second regulation member.

9. The drawer unit according to claim 8, wherein the operation unit includes a stopper portion that contacts the lock member to regulate rotation of the lock member from the second posture to the third posture.

10. The drawer unit according to claim 9, wherein the lock member does not engage with the first regulation member but engages with the second regulation member when the lock member contacts the stopper portion to regulate the rotation of the lock member.

11. The drawer unit according to claim 9, wherein the stopper portion contacts the lock member when the first operation is performed for the operation unit, but does not contact the lock member when the second operation is performed for the operation unit.

12. The drawer unit according to claim 1, wherein the first position is a position at which the drawer member is inserted to an innermost position of the storage unit, and the second position is a position at which the drawer member is drawn to a maximum in a state supported by the storage unit.

13. The drawer unit according to claim 2, wherein the operation unit includes a first contact portion that contacts and presses the lock member in the first operation, and a second contact portion that contacts and presses the lock member in the second operation, and the first contact portion and the second contact portion are disposed on sides opposite to each other with respect to a rotation center of the lock member.

14. The drawer unit according to claim 13, wherein the lock member includes a rotation portion whose intermediate portion is rotatably supported by the drawer member, a lever portion that extends from one end of the rotation portion, and a hook portion that extends in a direction opposite to the rotation portion from a tip of the lever portion, and is allowed to engage with the first regulation member or the second regulation member in accordance with a posture of the lock member, and each of the first regulation member and the second regulation member is a protrusion that protrudes toward the lock member from the storage unit.

15. The drawer unit according to claim 14, wherein the first contact portion contacts another end of the rotation portion, and the second contact portion contacts the one end of the rotation portion.

16. The drawer unit according to claim 14, wherein a protrusion amount of the first regulation member is smaller than a protrusion amount of the second regulation member.

17. An image forming apparatus comprising:

the drawer unit according to claim 1;

a paper feeding mechanism that extracts recording paper stored in the drawer unit; and an image forming unit that forms an image on the recording paper extracted from the paper feeding mechanism.

18. A drawer unit comprising:

a drawer member allowed to shift toward a storage unit in an inserting direction, or shift from the storage unit in a drawing direction;

a lock member rotatably supported by the drawer member;

a first regulation member that is included in the storage unit and engages with the lock member to regulate a shift of the drawer member in the drawing direction when the drawer member is located at a first position within the storage unit;

a second regulation member that is included in the storage unit and engages with the lock member to regulate a shift of the drawer member in the drawing direction when the drawer member is located at a second position drawn from the first position; and an operation unit that receives a first operation performed for the drawer member to rotate the lock member in the drawing direction and allow engagement between the lock member and the first regulation member, and a second operation performed for the drawer member to rotate the lock member in the inserting direction and allow engagement between the lock member and the second regulation member;

wherein the lock member is allowed to engage with the first regulation member in a first posture of the lock member, is allowed to engage with the second regulation member in a second posture of the lock member rotated in a predetermined direction from the first posture, and is released from engagement with the second regulation member in a third posture of the lock member further rotated in the predetermined direction from the second posture, and the lock member is rotated to the second posture by the first operation, and rotated to the third posture by the second operation.

* * * * *